US008915490B2

(12) United States Patent
Izumichi et al.

(10) Patent No.: US 8,915,490 B2
(45) Date of Patent: Dec. 23, 2014

(54) POST-PROCESSING APPARATUS, IMAGE FORMING APPARATUS, AND FOLDING APPARATUS

(71) Applicant: KYOCERA Document Solutions Inc., Osaka (JP)

(72) Inventors: Sachio Izumichi, Osaka (JP); Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 21 days.

(21) Appl. No.: 13/892,144

(22) Filed: May 10, 2013

(65) Prior Publication Data

US 2013/0307206 A1 Nov. 21, 2013

(30) Foreign Application Priority Data

May 17, 2012 (JP) ..... 2012-113157

(51) Int. Cl.

| | |
|---|---|
| ***B31F 1/10*** | (2006.01) |
| ***B31B 1/56*** | (2006.01) |
| ***B65H 39/00*** | (2006.01) |
| ***B65H 39/10*** | (2006.01) |
| ***B65H 45/18*** | (2006.01) |

(52) U.S. Cl.

CPC ..... *B65H 39/00* (2013.01); *B65H 2801/27* (2013.01); *B65H 2513/41* (2013.01); *B65H 39/10* (2013.01); *B65H 2513/511* (2013.01); *B65H 2511/20* (2013.01); *B65H 45/18* (2013.01)

USPC ..... 270/32; 270/58.07; 493/444

(58) Field of Classification Search

USPC ..... 270/32, 58.07; 493/405, 419, 424, 434, 493/435, 442, 444, 445, 437, 438

See application file for complete search history.

(56) References Cited

U.S. PATENT DOCUMENTS

| | | | | |
|---|---|---|---|---|
| 5,167,604 | A * | 12/1992 | Ohsawa | 493/23 |
| 6,746,390 | B2 | 6/2004 | Tamura et al. | |
| 6,779,790 | B2 | 8/2004 | Kitahara | |

(Continued)

FOREIGN PATENT DOCUMENTS

| | | | |
|---|---|---|---|
| JP | 2000-169028 | A | 6/2000 |
| JP | 2003-054832 | A | 2/2003 |

(Continued)

OTHER PUBLICATIONS

Notice of Rejection mailed by Japan Patent Office on Aug. 19, 2014 in the corresponding Japanese patent application No. 2012-113157—7 pages.

*Primary Examiner* — Leslie A Nicholson, III

(74) *Attorney, Agent, or Firm* — Knobbe, Martens, Olson & Bear LLP

(57) ABSTRACT

A post-processing apparatus includes a transport path, a loading part, a first folding member, a second folding member, a drive mechanism, a position detecting unit, a time information output part, a time monitoring part, and a rotational driving control part. The time monitoring part measures a moving time of the blade member from a first position between an initial position and a protrusion position to a second position, and determines whether the moving time has elapsed by a predetermined time. When the time monitoring part determines that the moving time has elapsed by the predetermined time, the rotational driving control part controls a rotary drive part so as to switch a rotational driving direction into a backward rotational direction.

8 Claims, 13 Drawing Sheets

(56) References Cited

U.S. PATENT DOCUMENTS

| | | | | |
|---|---|---|---|---|
| 7,871,065 | B2 | 1/2011 | Fukasawa et al. | |
| 8,028,980 | B2 | 10/2011 | Fukasawa et al. | |
| 8,162,303 | B2 | 4/2012 | Fukatsu et al. | |
| 8,177,211 | B2 * | 5/2012 | Iguchi et al. | 270/45 |
| 8,251,882 | B2 * | 8/2012 | Decker et al. | 493/419 |
| 8,317,179 | B2 * | 11/2012 | Takata | 270/37 |
| 8,336,869 | B2 | 12/2012 | Fukatsu et al. | |
| 2008/0182740 | A1 | 7/2008 | Fukasawa et al. | |
| 2010/0320672 | A1 | 12/2010 | Fukasawa et al. | |

FOREIGN PATENT DOCUMENTS

| | | | |
|---|---|---|---|
| JP | 2008-184324 | A | 7/2008 |
| JP | 2008-247531 | A | 10/2008 |
| JP | 2008-247534 | A | 10/2008 |
| JP | 2008-247535 | A | 10/2008 |
| JP | 2008-297059 | A | 12/2008 |
| JP | 2010-058916 | A | 3/2010 |
| JP | 2011-184190 | A | 9/2011 |

* cited by examiner

POST-PROCESSING APPARATUS, IMAGE FORMING APPARATUS, AND FOLDING APPARATUS

INCORPORATION BY REFERENCE

This application claims priority to Japanese Patent Application No. 2012-113157 filed on May 17, 2012, the entire contents of which are incorporated by reference herein.

BACKGROUND

The present disclosure relates to a post-processing apparatus, an image forming apparatus, and a folding apparatus, which are capable of folding a sheet such as a sheet-like image forming medium.

There is a post-processing apparatus that is connectable to the main body of an image forming apparatus such as a copy machine or a multifunction device. The post-processing apparatus performs predetermined post-processes on sheets (or a bundle of sheets) taken out of the image forming apparatus main body. The post-processes include, for instance, a punching process of the sheets, a stapling process of the sheet bundle, and a folding process of the sheets (sheet bundle).

The post-processing apparatus having a function of the folding process is equipped with a blade that comes into contact with the sheets (sheet bundle) to bend the sheets (sheet bundle), and a roller pair that receives the bent sheets (sheet bundle) so as to be sandwiched along with the blade to make a fold.

Here, in the folding process, the blade may be loaded and damaged depending on a material or number of the sheets (sheet bundle).

For this reason, there is proposed an image forming apparatus equipped with a clutch means that converts the roller pair into a rotatable state in a driven way with the blade and the sheets (sheet bundle) inserted between the rollers.

Further, there is also proposed an image forming apparatus configured to be able to adjust a contact pressure between the rollers in the state in which the blade and the sheets (sheet bundle) are inserted between the rollers.

However, in such image forming apparatuses, the blade may be damaged. In this case, the post-processing apparatus stops the process operation in the state in which the blade is inserted between the rollers. A workload for returning from this state back to a normal state is very great.

SUMMARY

The present disclosure is intended to suppress damage to a folding member and allow a work burden imposed to a worker to be recovered to return to a normal state when a malfunction occurs.

A post-processing apparatus and an image forming apparatus relating to an aspect of the present disclosure include a transport path, a loading part, a first folding member, a second folding member, a drive mechanism, a position detecting unit, a time information output part, a time monitoring part, and a rotational driving control part.

The transport path is allowed to transport image forming medium in a predetermined transport direction.

The loading part includes a loading face on which the image forming medium is loadable, and is formed with a penetration part that penetrates to an opposite face of the loading face and constitutes a part of the transport path.

The first folding member is disposed at a side of the opposite face in the loading part, is disposed so as to be movable between an initial position at which a tip thereof is located at a predetermined position of the side of the opposite face and a protrusion position at which the tip thereof is inserted into the penetration part and is located at a predetermined position of a side of the loading face, and moves from the initial position to the protrusion position in a state in which the image forming medium is disposed on the loading part, thereby moving the image forming medium while bending the image forming medium.

The second folding member is disposed at the side of the loading face in the loading part, and sandwiches and receives the first folding member along with the bent image forming medium in a state in which the first folding member is located at the protrusion position.

The drive mechanism includes a rotary drive part, a rotary member, and a changing part.

The rotary drive part is allowed to output a rotational driving force and to switch a rotational driving direction.

The rotary member is directly or indirectly connected to the rotary drive part and is rotated by the rotational driving force from the rotary drive part.

The changing part changes rotational motion of the rotary member into rectilinear reciprocating motion in a moving direction of the first folding member.

The position detecting unit detects that the first folding member is located at a first position between the initial position and the protrusion position and that the first folding member is located between the initial position and the protrusion position, which is located at a second position nearer the protrusion position than the first position.

The time information output part is allowed to output time information.

The time monitoring part measures a moving time that is a time from when the position detecting unit detects that the first folding member is located at the first position to when the position detecting unit detects that the first folding member is located at the second position based on the time information from the timer, and determines whether the moving time has elapsed by a predetermined time.

The rotational driving control part controls the rotary drive part so as to switch the rotational driving direction into a backward rotational direction when the time monitoring part determines that the moving time has elapsed by the predetermined time.

Further, a folding apparatus relating to an aspect of the present disclosure includes a transport path, a loading part, a first folding member, and a second folding member, which are set forth below, in addition to a drive mechanism, a position detecting unit, a time information output part, a time monitoring part, and a rotational driving control part, which are similar to those described above.

The transport path is allowed to transport sheet in a predetermined transport direction.

The loading part includes a loading face on which the sheet is loadable, and is formed with a penetration part that penetrates to an opposite face of the loading face and constitutes a part of the transport path.

The first folding member is disposed at a side of the opposite face in the loading part; which is disposed so as to be movable between an initial position at which a tip thereof is located at a predetermined position of the side of the opposite face and a protrusion position at which the tip thereof is inserted into the penetration part and is located at a predetermined position of a side of the loading face; and which moves from the initial position to the protrusion position in a state in which the sheet is disposed on the loading part, thereby moving the sheet while bending the sheet.

The second folding member is disposed at the side of the loading face in the loading part, and which sandwiches and receives the first folding member along with the bent sheet in a state in which the first folding member is located at the protrusion position.

DETAILED DESCRIPTION

Figure 1:
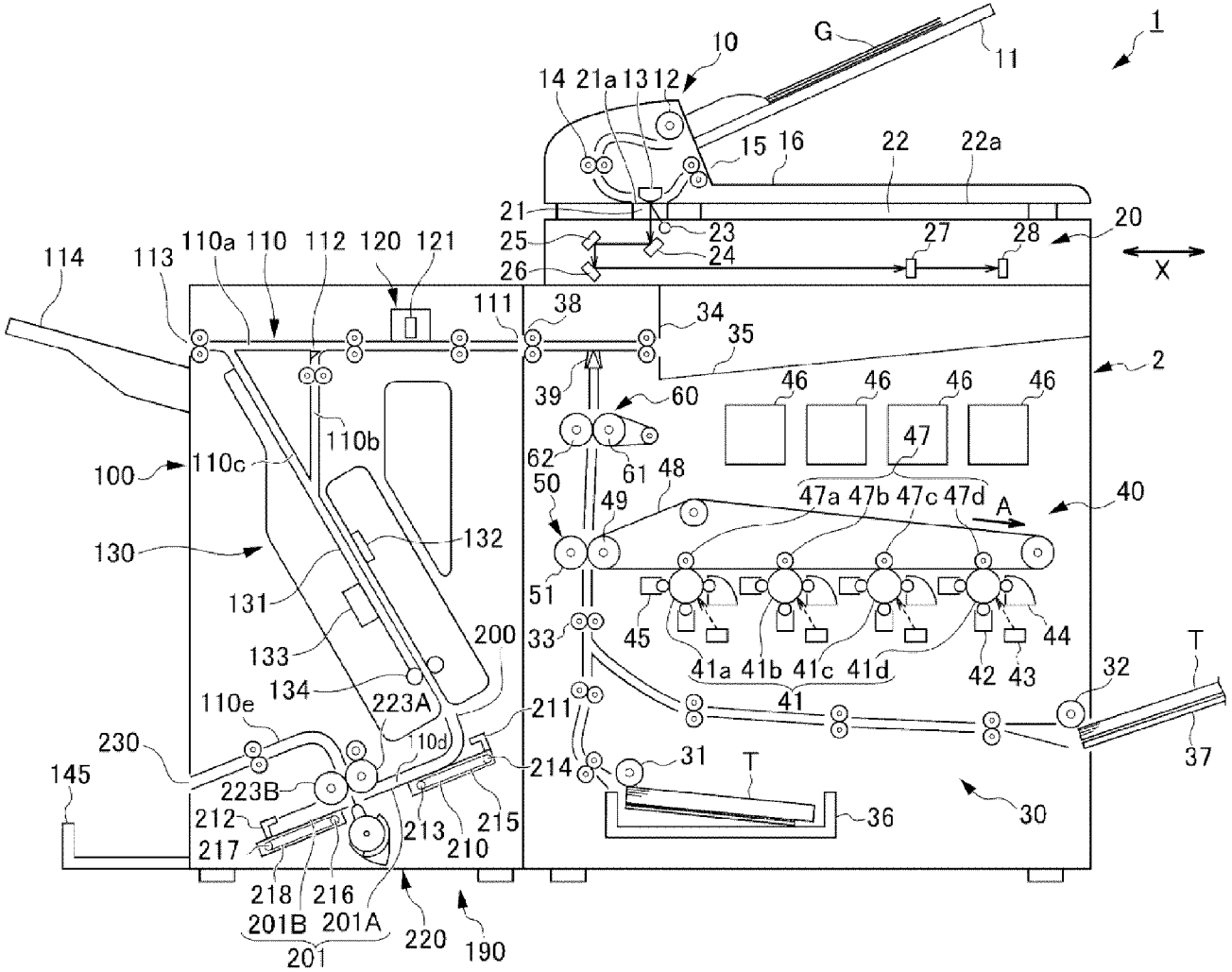
FIG. 1 is a view for describing an overall configuration of a copy machine.

Hereinafter, a post-processing apparatus, an image forming apparatus, and a folding apparatus relating to an embodiment serving as an aspect of the present disclosure will be described with reference to the drawings. A copy machine 1 serving as an embodiment of the image forming apparatus relating to the present disclosure will be described. First, an overall configuration of the copy machine 1 will be described. FIG. 1 is a view for describing the overall configuration of the copy machine.

The copy machine 1 is equipped with a copy machine main body (image forming apparatus main body) 2 that forms a toner image on paper (an image forming medium or a sheet) T, and a post-processing apparatus 100 that is disposed at a paper discharge side of the copy machine main body 2 and performs a punching process, a stapling process, and a center-folding process on the paper T on which the toner image is formed.

The copy machine main body 2 is equipped with a document transport unit 10, a document scanning unit 20, a first paper transport unit 30, a toner image forming unit 40, a transfer unit 50, and a fixing unit 60.

The document transport unit 10 is an auto document feeder (ADF), and is equipped with a document loading part 11, a first feed roller 12, a guide 13, a timing roller pair 14, and a document discharge part 15. The first feed roller 12 supplies documents G loaded on the document loading part 11 to a timing roller pair 14 one by one in turn. The timing roller pair 14 transports or stops transporting the document G in order to match a timing at which the document scanning unit 20 scans the document G and a timing at which the document G is supplied to a position at which the document G is scanned by the document scanning unit 20 (i.e. a position at which the guide 13 is disposed). The guide 13 guides the transported document G to a first scanning face 21*a* to be described below. The document discharge part 15 discharges the document Q which is scanned by the document scanning unit 20 (or which passes through the guide 13), to the outside of the copy machine main body 2.

In the document discharge part 15, a document accumulation part 16 is formed outside the copy machine main body 2. The documents G discharged from the document discharge part 15 are stacked and accumulated onto the document accumulation part 16.

The document scanning unit 20 is equipped with a first scanning face 21*a* and a second scanning face 22*a*. The first scanning face 21*a* is formed along an upper surface of a first contact glass 21 disposed opposite the guide 13, and becomes a face used to scan the document G The second scanning face 22*a* is disposed adjacent to the first scanning face 21*a* (in the case shown in FIG. 1, over most of the right side of the first scanning face 21*a*). The second scanning face 22*a* is used when the document G is scanned without using the document transport unit 10. The second scanning face 22*a* is formed along an upper surface of a second contact glass 22 on which the document G is loaded, and becomes a face used to scan the document G.

Further, the document scanning unit 20 is equipped with an illuminating part 23, a first mirror 24, a second mirror 25, a third mirror 26, an imaging lens 27, and an image capture part 28 inside the copy machine main body 2. Each of the illuminating part 23 and the first mirror 24 moves in a secondary scanning direction X. The second mirror 25 and the third mirror 26 are disposed at left sides of the illuminating part 23 and the first mirror 24 in FIG. 1. Furthermore, the second mirror 25 and the third mirror 26 move in the secondary scanning direction X while constantly maintaining a distance (length of a light path) from the first or second scanning face 21*a* or 22*a* to the image capture part 28 via the first mirror 24, the second mirror 25, the third mirror 26, and the imaging lens 27.

The illuminating part 23 is a light source that radiates light to the document G The first mirror 24, the second mirror 25, and the third mirror 26 are mirrors for guiding light reflected by the document G to the imaging lens 27 while constantly maintaining the length of light path. The imaging lens 27 forms an image of light incident from the third mirror 26 on the image capture part 28. The image capture part 28 is equipped with a plurality of image capture elements arranged in a primary scanning direction (direction perpendicular to the secondary scanning direction X). Each image capture element is an element for converting the incident light into an electric signal, and thereby obtaining image data based on the formed image of light, for example a charge-coupled device (CCD).

The first paper transport unit 30 is equipped with a second feed roller 31, a third feed roller 32, a resistration roller pair 33, a switching part 39, a first paper discharge part 34, and a second paper discharge part 38. The second feed roller 31 supplies the paper T stored in a paper feed cassette 36 to a transfer unit 50. The third feed roller 32 supplies the paper T loaded in a manual tray 37 to the transfer unit 50. The resistration roller pair 33 transports or stops transporting the paper T in order to match a timing at which a toner image is formed on the transfer unit 50 and a timing at which the paper T is supplied to the transfer unit 50. Further, the resistration roller pair 33 corrects a skew of the paper T (oblique paper feeding). The switching part 39 switches a transport direction of the paper T so as to transport the paper T, which is taken out of a fixing unit 60, to any one of the first paper discharge part 34 and the second paper discharge part 38. The first paper discharge part 34 and the second paper discharge part 38 discharge the paper T to which the toner image is fixed to the outside of the copy machine main body 2. In the first paper discharge part 34, a discharge paper accumulation part 35 is formed outside the copy machine main body 2. The paper T discharged from first paper discharge part 34 is unloaded on to the discharge paper accumulation part 35 in layers.

The toner image forming unit 40 is equipped with a photosensitive drum 41, a charging part 42, a laser scanner unit 43, a developing unit 44, a cleaning part 45, a toner cartridge 46, a primary transfer roller 47, an intermediate transfer belt 48, and a counter roller 49.

The photosensitive drum 41 (41*a*, 41*b*, 41*c*, and 41*d*) functions as a photoconductor or an image carrier to form each of black, cyan, magenta, and yellow toner images. The charging part 42, the laser scanner unit 43, the developing unit 44, and the cleaning part 45 are disposed around each of the photosensitive drums 41*a*, 41*b*, 41*c*, and 41*d* from an upstream side to a downstream side in a rotational direction of the photosensitive drum 41 in turn. The charging part 42 charges a surface of the photosensitive drum 41. The laser scanner unit 43 is disposed apart from the surface of the photosensitive drum 41, and scans and exposes the surface of the photosensitive drum 41 based on the image data associated with the document G scanned by the document scanning unit 20. Thereby, electric charges of the exposed portion are removed, and an electrostatic latent image is formed on the surface of the photosensitive drum 41. The developing unit 44 attaches toner to the electrostatic latent image formed on the surface of the photosensitive drum 41, thereby forming a toner image. After the surface of the photosensitive drum 41 is subjected to charge neutralization by a charge neutralization unit (not shown), the cleaning part 45 removes the toner remaining on the surface of the photosensitive drum 41.

The toner cartridge 46 contains the toner of each color which is supplied to the developing unit 44. The toner cartridge 46 and the developing unit 44 are connected by a toner supply passage (not shown).

The primary transfer roller 47 (47*a*, 47*b*, 47*c*, and 47*d*) is disposed at the opposite side of the photosensitive drum 41 (41*a*, 41*b*, 41*c*, and 41*d*) via the intermediate transfer belt 48. The intermediate transfer belt 48 is a belt passing through the toner image forming unit 40 and the transfer unit 50. The intermediate transfer belt 48 is partly sandwiched between respective pairs of the photosensitive drums 41*a*, 41*b*, 41*c*, and 41*d* and the primary transfer rollers 47*a*, 47*b*, 47*c*, and 47*d*, and the toner image formed on the surface of each of the photosensitive drums 41*a*, 41*b*, 41*c*, and 41*d* is primarily transferred to the intermediate transfer belt 48. The counter roller 49 is a driving roller that is disposed inside the intermediate transfer belt 48 of an annular shape, and that is used to advance the intermediate transfer belt 48 in a direction of an arrow A shown in FIG. 1.

The transfer unit 50 is equipped with a secondary transfer roller 51. The secondary transfer roller 51 is disposed at the opposite side of the counter roller 49 via the intermediate transfer belt 48, and a part of the intermediate transfer belt 48 is sandwiched between the counter roller 49 and the secondary transfer roller 51. Furthermore, the secondary transfer roller 51 secondarily transfers the toner image primarily transferred to the intermediate transfer belt 48 to the paper T.

The fixing unit 60 is equipped with a heating rotor 61 and a pressurizing rotor 62. The heating rotor 61 and the pressurizing rotor 62 switch the paper T to which the toner image is secondarily transferred, melt and heat a toner, and fix the toner to the paper T.

The post-processing apparatus 100 is configured to be connectable to the copy machine main body 2. The post-processing apparatus 100 is equipped with a second paper transport unit (transport path) 110, a punching unit 120, a stapling unit 130, and a folding unit 190.

The second paper transport unit 110 includes a transport path 110*a*, a transport path 110*b*, a transport path 110*c*, a transport path 110*d*, and a transport path 110*e*. The second paper transport unit 110 is configured to be able to transport sheet-like paper T in a predetermined transport direction.

The transport path 110*a* is equipped with an ingoing part 111, a branch guide 112, and a first discharge part 113.

The ingoing part 111 carries the paper T, which is discharged from the second paper discharge part 38 of the copy machine main body 2, into the post-processing apparatus 100, and transports the paper T to the punching unit 120.

The branch guide 112 switches the transport direction of the paper T discharged from the punching unit 120 to any one of the first discharge part 113 and the stapling unit 130.

The first discharge part 113 discharges, from the post-processing apparatus 100, the paper T discharged from the punching unit 120 and the paper T discharged from the stapling unit 130.

In the first discharge part 113, a main tray 114 is disposed outside the post-processing apparatus 100. The paper T discharged from the first discharge part 113 is stacked and accumulated on the main tray 114.

The punching unit 120 performs a series of processes associated with a punching process of forming holes, which are used to bind the paper T, at given positions of the paper.

The stapling unit 130 staples the paper T with staples (binding needles) (stapling process), and is equipped with a paper cradle 131, a catching part 132, a stapling part 133, and transport rollers 134. Here, the paper cradle 131, the catching part 132, and the transport rollers 134 constitute a part of the transport path 110*c*.

The paper cradle 131 temporarily accumulates a plurality of sheets of paper T carried from the punching unit 120 by switching of the branch guide 112.

The catching part 132 takes and holds lower ends of the sheets of paper T carried into the paper cradle 131.

The stapling part 133 moves to the vicinity of ends or middles of the sheets of paper T temporarily accumulated in the paper cradle 131, and staples the vicinity of ends or middles of the sheets of paper T.

The transport rollers 134 transports a bundle of the sheets of paper T, the vicinity of middles of which have undergone the stapling process (saddle stitch binding), from the paper cradle 131 to the folding unit 190.

The folding unit 190, for instance, folds the paper bundle undergoing the saddle stitch binding in half from the vicinity of the middle of the paper bundle (folding process). The folding unit 190 will be described below in detail.

Figure 2:
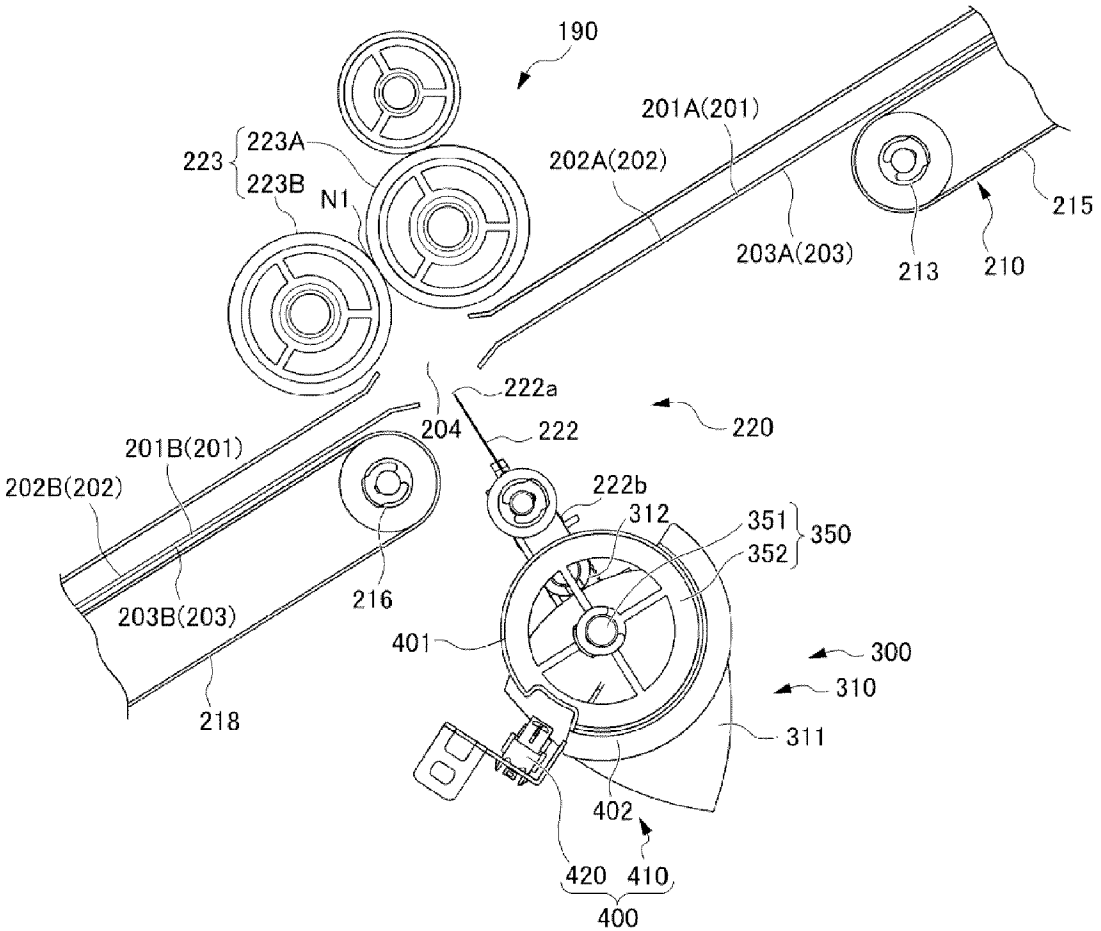
FIG. 2 is a view for describing a configuration of a folding unit constituting a post-processing apparatus.
Figure 3A:
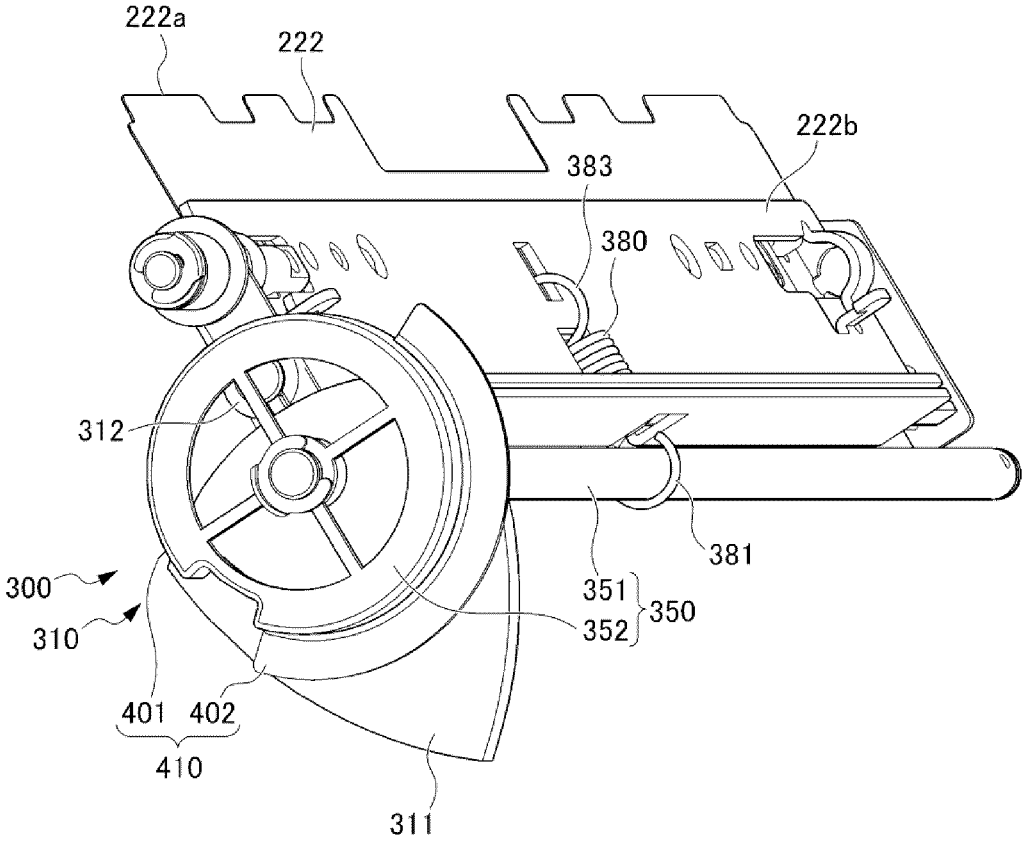
FIG. 3A is a view for describing a cam mechanism constituting the folding unit.
Figure 3B:
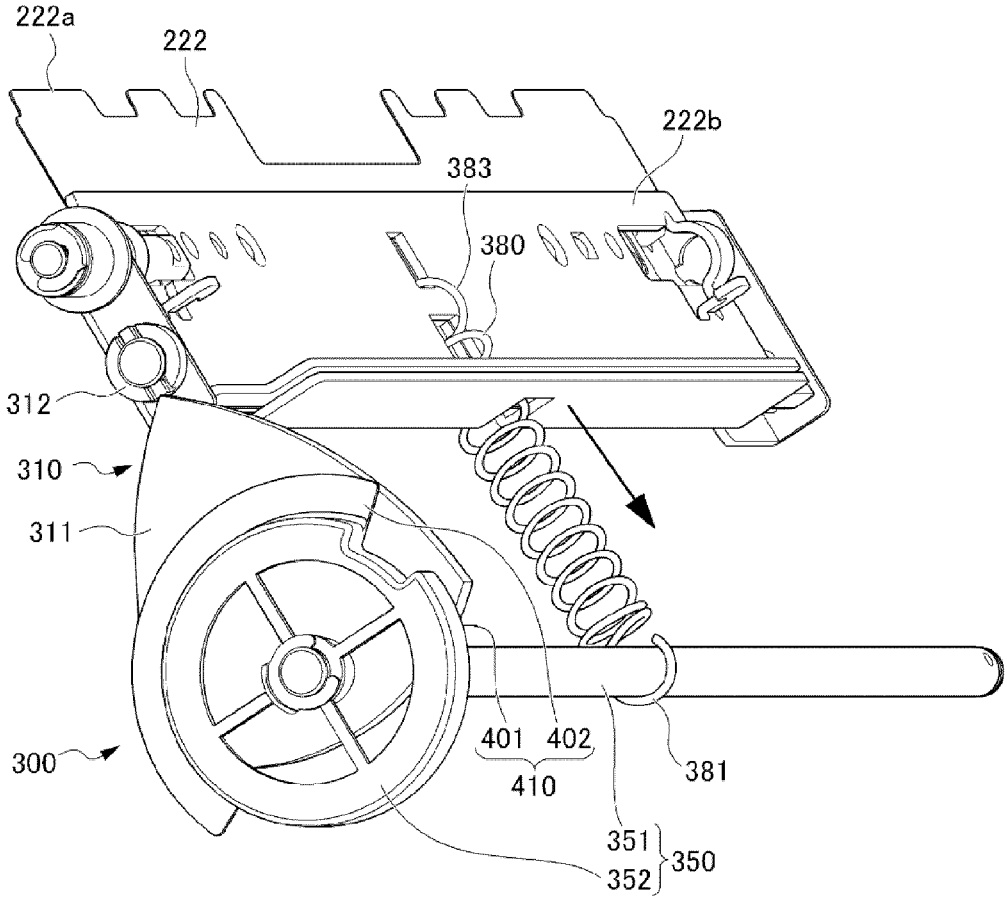
FIG. 3B is a view for describing the cam mechanism constituting the folding unit.

In the post-processing apparatus (folding apparatus) 100 of the present embodiment, the folding unit 190 will be described based on FIGS. 2 to 3B. FIG. 2 is a view for describing a configuration of the folding unit constituting the post-processing apparatus. FIG. 3A is a view for describing a cam mechanism constituting the folding unit. FIG. 3B is a view for describing a cam mechanism constituting the folding unit. In the following description, for convenience, a bundle of sheets of paper T are included in the "paper T."

As shown in FIG. 1, the folding unit 190 is disposed at a downstream side of the second paper transport unit 110. For example, a sheet of paper T or a bundle of sheets of paper T on which the stapling process is performed are introduced into the folding unit 190. The folding unit 190 performs a folding process on the introduced paper T. Then, the folding unit 190 discharges the paper T on which the folding process is performed to a lower discharge tray 145 installed at a lower portion of one side of the post-processing apparatus 100.

The folding unit 190 is equipped with a sheet ingoing path 200, a sheet loading member (loading part) 201 having a sheet loading face (loading face) 202, a matching part 210, an extrusion member 211, a catching member 212, a folding part 220, and a second discharge part 230.

The sheet ingoing path 200 is an ingoing path for carrying the paper T, which is transported from the transport path, into the folding unit 190. As shown in FIG. 1, the sheet ingoing path 200 is disposed at a right-hand upper portion of the folding unit 190. The sheet ingoing path 200 transports the paper T toward the sheet loading member 201 (the sheet loading face 202).

The sheet loading member 201 constitutes a part of the transport path 110*d* (the second paper transport unit 110), and includes the sheet loading face 202 on which the sheet-like paper T can be loaded.

The sheet loading member 201 is equipped with an upstream-side sheet loading member 201A, a downstream-side sheet loading member 201B, and a penetration part 204.

The upstream-side sheet loading member 201A includes an upstream-side sheet loading face 202A. Further, the downstream-side sheet loading member 201B includes a downstream-side sheet loading face 202B.

The upstream-side sheet loading member 201A and the downstream-side sheet loading member 201B are members for loading the paper T to perform the folding process on the carried paper T.

The upstream-side sheet loading member 201A and the downstream-side sheet loading member 201B are disposed so as to extend from a right upper side to a left lower side of an interior of the folding unit 190. The upstream-side sheet loading member 201A and the downstream-side sheet loading member 201B are disposed across the penetration part 204.

The upstream-side sheet loading member 201A and the downstream-side sheet loading member 201B are formed of a plate-like member. The upstream-side sheet loading member 201A and the downstream-side sheet loading member 201B are disposed so as to be in a straight line in the transport direction of the sheet.

The paper T loaded on the upstream-side sheet loading member 201A and the downstream-side sheet loading member 201B is fed into a first nip N1 of a folding roller pair 223 by a blade member 222 (which will be described below) inserted into the penetration part 204.

The penetration part 204, which is penetrated from a side of the sheet loading face 202 toward a side of an opposite face 203 on the opposite side of the sheet loading face 202, is formed in the sheet loading face 202. The penetration part 204 is disposed between the upstream-side sheet loading member 201A and the downstream-side sheet loading member 201B. The penetration part 204 is a through-hole into which the blade member 222 is inserted.

The matching part 210 is provided to match a position of the paper T in the upstream-side and downstream-side sheet loading members 201A and 201B so as to accurately perform the folding process on the carried paper T. The matching part 210 matches the paper T in a direction (a left-hand downward direction in FIG. 1) parallel to the transport direction of the paper T and in a direction perpendicular to the transport direction of the paper T.

As shown in FIG. 1, the extrusion member 211 and the catching member 212 are provided to match leading and trailing ends of the paper T in the transport direction of the paper T. The extrusion member 211 is disposed at an upstream side of the transport direction of the sheet. The catching member 212 is disposed at a downstream side of the transport direction of the sheet.

The extrusion member 211 is formed so that a cross section thereof has an approximate L shape. A driving pulley 213 and a driven pulley 214 are disposed below the upstream-side sheet loading member 201A. An endless belt 215 is put across the driving pulley 213 and the driven pulley 214. The extrusion member 211 is mounted on the endless belt 215. Further, the extrusion member 211 protrudes from the top of the upstream-side sheet loading member 201A at an approximately middle position of a widthwise direction of the upstream-side sheet loading member 201A.

The driving pulley 213 is disposed at a position that corresponds to an approximately central portion of the transport direction of the sheet in the upstream-side sheet loading member 201A. The driven pulley 214 is disposed near an upstream-side end of the upstream-side sheet loading member 201A. Further, a rotational driving force from a motor (not shown) is transmitted to the driving pulley 213 by a drive mechanism (not shown). The driving pulley 213 and the driven pulley 214 are configured to be rotatable forward/backward. If the driving pulley 213 is rotationally driven, the driven pulley 214 rotates in a driven way via the endless belt 215. Thereby, the extrusion member 211 protrudes from the top of the upstream-side sheet loading member 201A and moves in a direction parallel with the transport direction of the sheet.

The catching member 212 is formed so that a cross section thereof has an approximate L shape. A driving pulley 216 and a driven pulley 217 are disposed below the downstream-side sheet loading member 201B. An endless belt 218 is put across the driving pulley 216 and the driven pulley 217. The catching member 212 is mounted on the endless belt 218. Further, the catching member 212 is configured so as to protrude from the top of the downstream-side sheet loading member 201B at an approximately middle position of a widthwise direction of the downstream-side sheet loading member 201B.

The driving pulley 216 is disposed near an upstream-side end of the downstream-side sheet loading member 201B. The driven pulley 217 is disposed near a downstream-side end of the downstream-side sheet loading member 201B. Further, a rotational driving force from a motor (not shown) is transmitted to the driving pulley 216 by a drive mechanism (not shown). The driving pulley 216 and the driven pulley 217 are configured to be rotatable forward/backward. If the driving pulley 216 is rotationally driven, the driven pulley 217 rotates in a driven way via the endless belt 218. Thereby, the catching member 212 protrudes from the top of the downstream-side sheet loading member 201B, and moves throughout the length of the downstream-side sheet loading member 201B in a direction parallel with the transport direction of the sheet.

The extrusion member 211 and the catching member 212 are moved in conformity with a size (length of the transport direction) of the paper T. Thereby, a position of the paper T carried into the upstream-side sheet loading member 201A and the downstream-side sheet loading member 201B is matched in the direction parallel with the transport direction of the sheet, i.e. in a lengthwise direction of the paper T.

Width adjustment members (not shown) are members for matching the paper T in a direction orthogonal to the transport direction of the paper T, i.e. in a widthwise direction of the paper T. The width adjustment members are provided in a pair in the direction parallel with the transport direction of the paper T. The pair of width adjustment members are disposed on top of the upstream-side and downstream-side sheet loading members 201A and 201B across the blade member 222 in the transport direction of the sheet at a distance in the widthwise direction. The width adjustment and skew correction of the paper T are performed by the pair of width adjustment members. The pair of width adjustment members provided on top of the upstream-side sheet loading member 201A include a rack-and-pinion mechanism (not shown). This rack-and-pinion mechanism is connected to and driven by a forward/backward rotatable motor (not shown).

The width adjustment members are moved in conformity with the size (length of the transport direction) of the paper T, which is carried on top of the upstream-side sheet loading member 201A and the downstream-side sheet loading member 201B, by the rack-and-pinion mechanism and the motor. Thereby, the matching including the width adjustment and skew correction of the paper T is performed.

The folding part 220 forms a fold in the paper T at the first nip N1 (which will be described below). Further, the folding part 220 sends the paper T, in which the fold is formed, toward the second discharge part 230.

The folding part 220 is equipped with a blade member (first folding member) 222 and a folding roller pair (second folding member) 223. Further, the folding part 220 includes a drive mechanism 300 and a position detecting mechanism (position detecting unit) 400.

The blade member 222 is a member for coming into contact with the paper T to fold the paper T.

The blade member 222 includes a tip 222*a* coming into contact with the paper T. An end of the blade member 222 which is located at the opposite side of the tip 222*a* is held by a holding member 222*b*.

The blade member 222 is disposed at the side of the opposite face 203 of the sheet loading face 202 in the sheet loading member 201 so as to be able to move between an initial position HP (see FIG. 6) at which the tip 222*a* is located at a predetermined position of the side of the opposite face 203 and a protrusion position TP (see FIG. 8) at which the tip 222*a* is inserted into the penetration part 204 and is located at a predetermined position of a side of the sheet loading face 202.

In a state in which the paper T is disposed on the sheet loading member 201, the blade member 222 moves from the initial position HP to the protrusion position TP, thereby moving the paper T while bending the paper T.

In detail, the blade member 222 is caused to push the paper T to come into contact with the paper T, and sends the paper T into the first nip N1 (to be described below) while curving (folding) the paper T. The blade member 222 moves in a direction that is approximately orthogonal to the sheet loading face 202, including the transport direction of the sheet and the widthwise direction of the sheet.

Here, the blade member 222 is disposed so as to be able to move from a first position P1 between the initial position HP and the protrusion position TP to a second position P2 nearer the protrusion position TP than the first position P1 that is between the initial position HP and the protrusion position TP.

In the process of moving from the initial position HP to the protrusion position TP, the blade member 222 is located at the first position P1, and continues to be located at the second position P2.

The positions of the first position P1 and the second position P2 are not particularly limited outside of the aforementioned conditions. However, the second position P2 is preferably adjacent to the protrusion position TP. For example, the second position P2 is preferably a position nearer the protrusion position TP than a midpoint between the initial position HP and the protrusion position TP. Further, the second position P2 is preferably a position at which the tip of the blade member 222 is sandwiched at the first nip N1.

Here, in the present embodiment, the first position P1 is the initial position HP, whereas the second position P2 is the protrusion position TP.

The folding roller pair 223 is disposed at the side of the sheet loading face 202 in the sheet loading member 201. In the present embodiment, the folding roller pair 223 is disposed above the blade member 222.

The folding roller pair 223 includes a first roller 223A and a second roller 223B. Both the first roller 223A and the second roller 223B constituting the folding roller pair 223 are configured to be rotationally driven via a rotary drive mechanism (not shown).

The first nip N1 is formed between the first roller 223A and the second roller 223B.

In a state in which the blade member 222 is located at the protrusion position TP, the folding roller pair 223 is caused to sandwich and receive the blade member 222 along with the bent paper T.

The drive mechanism 300 reciprocates the blade member 222 between the initial position HP and the protrusion position TP. Further, the drive mechanism 300 moves the blade member 222 from the first position P1 between the initial position HP and the protrusion position TP to the second position P2 nearer the protrusion position TP than the first position P1 that is between the initial position HP and the protrusion position TP. In the process of moving the blade member 222 from the initial position HP to the protrusion position TP, the drive mechanism 300 puts the blade member 222 at the first position P1, and continues to put the blade member 222 at the second position P2.

The drive mechanism 300 includes a rotary drive part 360 (see FIG. 4), a rotary member 350 (see FIG. 2), and a cam mechanism (changing unit) 310.

The rotary drive part 360 is allowed to output a rotational driving force, and is configured to be able to switch a rotational driving direction. The rotary drive part 360 is configured to include, for instance, a motor.

The rotary drive part 360 is configured to be able to switch a rotational direction to, for instance, a forward rotational direction that is a typical rotational direction and a backward rotational direction that is the reverse rotational direction of the forward rotational direction.

Here, as the motor constituting the rotary drive part 360, for example, a variety of motors such as a stepping motor, a brushed motor, and a brushless motor may be used.

Figure 4:
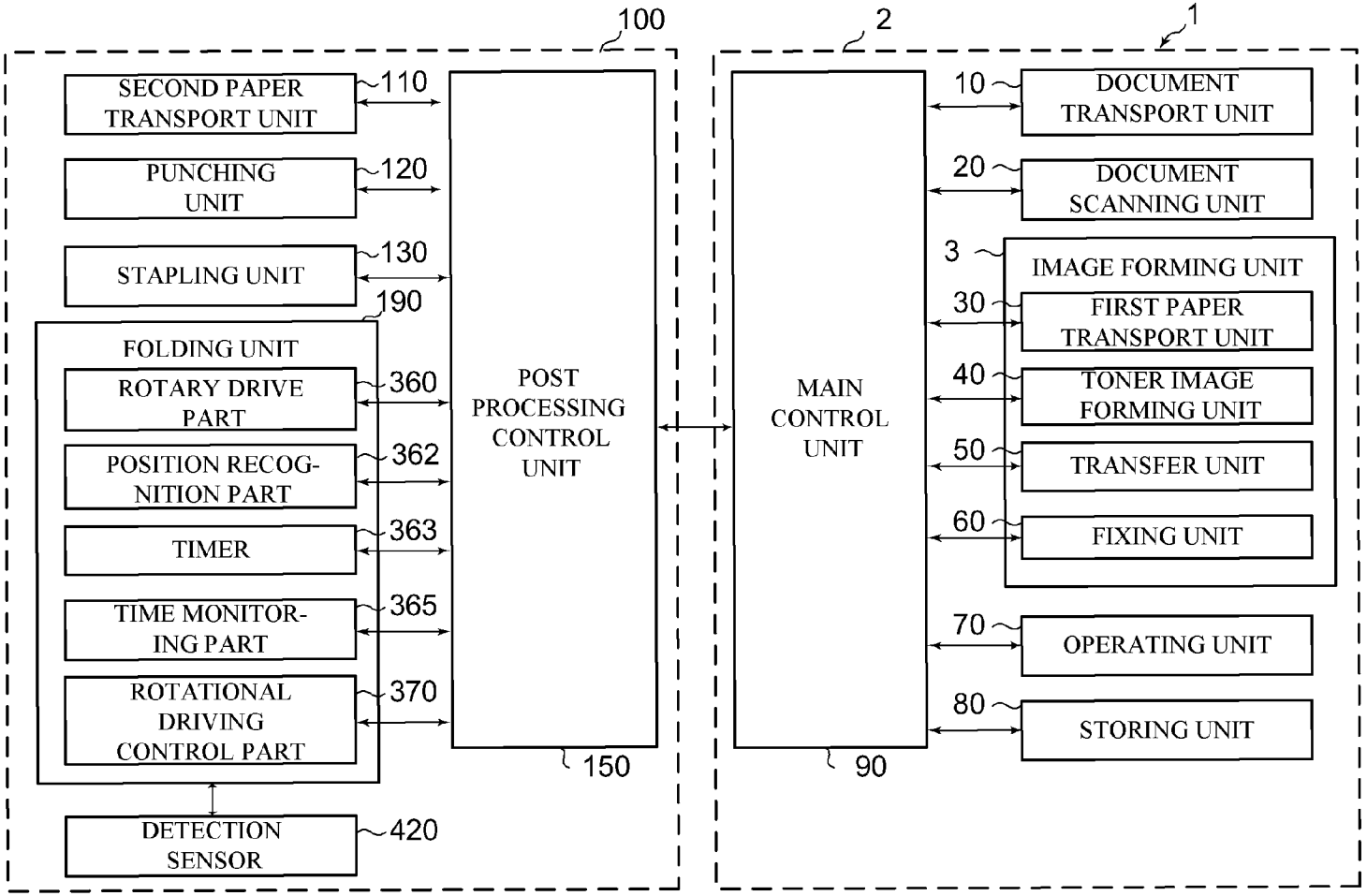
FIG. 4 is a block diagram showing a functional configuration in the copy machine (post-processing apparatus).

The rotary drive part 360 is controlled by a rotational driving control part 370 (which will be described below, see FIG. 4). For example, when a time monitoring part 365 to be described below determines that a moving time to be described below has elapsed by a predetermined time, the rotary drive part 360 is controlled so as to switch the rotational driving direction into the backward rotational direction by the rotational driving control part 370.

Here, the moving time is a time after a position detecting mechanism 400 (position recognition part 362) detects that the blade member 222 is located at the first position P1 (initial position HP) based on time information from a timer 363, and a time until the position detecting mechanism 400 (position recognition part 362) detects that the blade member 222 is located at the second position P2 (protrusion position TP). The moving time is measured by the time monitoring part 365 to be described below.

Further, in a state in which the rotational direction is controlled so as to be reversed as described above, the rotary drive part 360 is controlled so as to stop the rotational driving by the rotational driving control part 370 when the position detecting mechanism 400 (position recognition part 362) detects that the blade member 222 is located at the initial position HP.

The rotary member 350 is directly or indirectly connected to the rotary drive part 360.

The rotary member 350 includes a shaft member 351 and a rotating plate member 352 connected to one end of the shaft member 351.

The rotary member 350 is rotated by the rotational driving force from the rotary drive part 360.

That is, the shaft member 351 is rotated by the rotational driving force from the rotary drive part 360. Thus, the rotating plate member 352 is rotated by the rotational driving force from the rotary drive part 360 via the shaft member 351.

The cam mechanism 310 is a drive mechanism that changes rotational motion of the rotary member 350 into reciprocating motion. The cam mechanism 310 changes the rotational motion into the reciprocating motion so that, when the rotary member 350 rotates once, the blade member 222 reciprocates once.

The cam mechanism 310 includes a cam member 311, a contact member 312, and a spring member 380. The cam member 311 is connected to the shaft member 351 in the rotary member 350, and is integrally rotated along with the rotary member 350.

The contact member 312 is formed on the holding member 222*b* that holds the blade member 222. The contact member 312 is disposed so as to be in contact with an outer edge of the cam member 311. The contact member 312 is configured so as to make the reciprocating motion by the rotation of the cam member 311. Here, since the blade member 222 is held on the holding member 222*b* on which the contact member 312 is formed, when the contact member 312 makes the reciprocating motion, the blade member 222 also makes the reciprocating motion.

The spring member 380 is configured so that one end 381 thereof is connected to the shaft member 351 and so that the other end 383 thereof is connected to the holding member 222*b*. The spring member 380 biases the contact member 312 toward the cam member 311 via the shaft member 351 and the holding member 222*b*.

The spring member 380 maintains a state in which the contact member 312 is in contact with the outer edge of the cam member 311.

The position detecting mechanism 400 detects a rotational position of the rotary member 350, and detects a position of the blade member 222.

The position detecting mechanism 400 detects that the blade member 222 is located at the initial position HP, and detects that the blade member 222 is located at the protrusion position TP. The position detecting mechanism 400 detects that the blade member 222 is located at the first position P1 between the initial position HP and the protrusion position TP, and detects that the blade member 222 is located at the second position P2 nearer the protrusion position TP than the first position P1 that is between the initial position HP and the protrusion position TP.

The position detecting mechanism 400 includes a detected part 410, a detection sensor 420, and the position recognition part 362 to be described below. The position recognition part 362 will be described below.

The detected part 410 is formed at an outer edge of the rotating plate member 352 constituting the rotary member 350. The detected part 410 includes a first detection region (transmitted region) 401 and a second detection region (untransmitted region) 402.

The first detection region 401 is an outer edge of the rotating plate member 352. The outer edge of the rotating plate member 352 which acts as the first detection region 401 does not extend outward up to a position at which light output from the detection sensor 420 to be described below is blocked, and existence thereof is not detected by the detection sensor 420 when the blade member 222 is located between the initial position HP and just before the protrusion position TP. In other woeds, in the present embodiment, the first detection region 401 transmits the light output from the detection sensor 420.

The second detection region 402 is the outer edge of the rotating plate member 352, and is formed at a position that becomes a position to be measured by the detection sensor 420 to be described below in a state in which the blade member 222 is located between the protrusion position TP and just before the initial position HP. In the present embodiment, the second detection region 402 is a region (an untransmitted region or a light-blocking region) that does not transmit the light output from the detection sensor 420.

The aspect of the detected part 410 is not limited to the above description.

The detection sensor 420 is, for instance, a photosensor, and is disposed at a position at which it faces the detected part 410. For instance, the detection sensor 420 is in non-contact with the second detection region 402. The detection sensor 420 includes, a light-emitting part that is located at a position at which it faces one side of the second detection region 402, and a light-receiving part that is a position capable of receiving light from the light-emitting part and is located at a position at which it faces the other side of the second detection region 402. The detection sensor 420 acquires detection information (position information) showing whether or not it detects the detected part 410 based on whether or not the light from the light-emitting part is received by the light-receiving part. The detection sensor 420 acquires detection information showing that it detects the detected part 410 when the light-receiving part receives the light from the light-emitting part, and detection information showing that it fails to detect the detected part 410 when the light-receiving part fails to receive the light from the light-emitting part. The detection sensor 420 outputs the acquired detection information. In other words, the detection sensor 420 detects a rotational position of the rotary member 350 (rotating plate member 352), and outputs information about the rotational position. The rotational position information from the detection sensor 420 is output to the position recognition part 362.

Next, a functional configuration of the copy machine 1 will be described based on FIG. 4. FIG. 4 is a block diagram showing a functional configuration in the copy machine (post-processing apparatus).

The copy machine main body 2 includes the aforementioned components (the document transport unit 10, the document scanning unit 20, the first paper transport unit 30, the toner image forming unit 40, the transfer unit 50, and the fixing unit 60). The first paper transport unit 30, the toner image forming unit 40, the transfer unit 50, and the fixing unit 60 constitute an image forming unit 3. Description of these components will be omitted. Further, the copy machine main body 2 is equipped with an operating unit 70, a storing unit 80, and a main control unit 90 in addition to the aforementioned components.

The operating unit 70 is equipped with a numerical keypad (not shown), a touch panel (not shown), and a start key (not shown). The numerical keypad is operated to input a number such as a print run. The touch panel displays a plurality of keys to which various functions (as an example, a setting function of printing magnification, a function (2-in-1) of assigning a plurality of pages to a sheet of paper T, or a function of implementing a punching process, a stapling process, or a center-folding process) are allotted. The keys displayed on the touch panel are operated (touched) to carry out any one of the various functions on the copy machine 1. The start key is operated to carry out printing. When a key is operated, the operating unit 70 sends a signal to the main control unit 90 to indicate that the key is operated.

The storing unit 80 is made up of a hard disk, a semiconductor memory, and so on. The storing unit 80 stores image data based on the document G scanned by the document scanning unit 20. Further, the storing unit 80 stores a control program used in the copy machine 1, and data used by this control program.

The main control unit 90 controls the document transport unit 10, the document scanning unit 20, the image forming unit 3, a touch panel that forms the operating unit 70, and a post-processing control unit 150.

The post-processing apparatus 100 includes the aforementioned components (the second paper transport unit 110, the punching unit 120, the stapling unit 130, and the folding unit 190). Description of these components will be omitted. Further, the post-processing apparatus 100 includes the post-processing control unit 150 and the storing unit 600 in addition to the aforementioned components.

The folding unit 190 includes the rotary drive part 360, the position recognition part 362, the timer (time information output part) 363, the time monitoring part 365, and the rotational driving control part 370. The rotary drive part 360 is as described above.

The position recognition part 362 constitutes, as described above, the position detecting mechanism 400.

The position recognition part 362 detects that the blade member 222 is located at the first position P1 between the initial position HP and the protrusion position TP, and that the blade member 222 is located at the second position P2 nearer the protrusion position TP than the first position P1 that is between the initial position HP and the protrusion position TP, based on the rotational position information from the detection sensor 420.

Here, in the present embodiment, the first position P1 is the initial position HP and the second position P2 is the protrusion position TP. For this reason, the position recognition part 362 detects (recognizes) that the blade member 222 is located at the initial position HP and that the blade member 222 is located at the protrusion position TP.

In detail, when a series of operations are set to an operation procedure of moving the blade member 222 to the initial position HP when the previous operation is terminated, the position recognition part 362 receives a signal to the effect that the rotary drive part 360 is driven from the rotational driving control part 370. The position recognition part 362 receives a signal to the effect that a first detection region 401 is detected (i.e. the transmission of light is detected, "detected") from the detection sensor 420. Then, the position recognition part 362 detects that the blade member 222 is located at the initial position HP (first position P1).

Further, when the series of operations are set to the operation procedure of moving the blade member 222 to the initial position HP at the onset of the operation, the position recognition part 362 receives a signal to the effect that the rotary drive part 360 has been driven (completed) so as to locate the blade member 222 at the initial position HP from the rotational driving control part 370. Then, the position recognition part 362 detects that the blade member 222 is located at the initial position HP (first position P1).

Then, the position recognition part 362 notifies the time monitoring part 365 to be described below of the effect that the blade member 222 is located at the initial position HP (first position P1).

Further, after it is detected that the blade member 222 is located at the initial position HP (first position P1), if the position recognition part 362 receives a signal, which indicates that the second detection region 402 is detected (i.e. the transmission of light is not detected, "undetected"), from the detection sensor 420 (i.e., if the position recognition part 362 recognizes that a detected content is switched), the position recognition part 362 detects that the blade member 222 is located at the protrusion position TP (second position P2).

Then, the position recognition part 362 notifies the time monitoring part 365 to be described below of the effect that the blade member 222 is located at the protrusion position TP (second position P2).

The timer (time information output part) 363 is configured to be able to output time information. The timer 363 outputs the time information to the time monitoring part 365.

The time monitoring part 365 measures a moving time, which is a time after the position recognition part 362 detects that the blade member 222 is located at the initial position HP (first position P1) and which is a time until the position recognition part 362 detects that the blade member 222 is located at the protrusion position TP (second position P2) based on the time information from the timer 363.

Here, the time monitoring part 365 terminates the time measuring if it is detected by the position recognition part 362 that the blade member 222 is located at the protrusion position TP (second position P2). Further, the time monitoring part 365 may output the result of measuring the time to a predetermined storing unit, or delete the result.

In addition, the time monitoring part 365 determines whether the measured moving time has elapsed by a predetermined time.

For example, the time monitoring part 365 is configured so that, until it is detected by the position recognition part 362 that the blade member 222 is located at the protrusion position TP (second position P2), a time to be measured is added based on the time information from the timer 363, and so that, at the point of time when the moving time that is measured has elapsed by a predetermined time, it is determined that the moving time has elapsed by the predetermined time.

When the blade member 222 moves from the initial position HP (first position P1) to the protrusion position TP (second position P2) within the predetermined time, the time monitoring part 365 determines that the measured moving time has not elapsed by the predetermined time.

Further, when the blade member 222 cannot move from the initial position HP (first position P1) to the protrusion position TP (second position P2) within the predetermined time (i.e. when the moving time exceeds the predetermined time), the time monitoring part 365 determines that the moving time has elapsed by the predetermined time at the point of time when the moving time that is measured has elapsed by the predetermined time.

Thus, when it is determined that the measured moving time has elapsed by the predetermined time, the time monitoring part 365 notifies the rotational driving control part 370 of that effect.

Here, the time monitoring part 365 start to measure the moving time from the point of time when the position recognition part 362 detects that the blade member 222 is located at the initial position HP (first position P1). For this reason, the time monitoring part 365 measures the moving time in a state in which the blade member 222 moves from the initial position HP toward the protrusion position TP (i.e. moves so as to be pushed into the first nip N1 at the tip 222*a* while bending the paper).

The rotational driving control part 370 controls the rotary drive part 360.

When the time monitoring part 365 determines that the moving time has elapsed by the predetermined time, the rotational driving control part 370 controls the rotary drive part 360 so as to switch the rotational driving direction into the backward rotational direction.

In detail, the rotational driving control part 370 receives a notice to the effect that it is determined that the measured moving time has elapsed by the predetermined time from the time monitoring part 365.

Thus, when receiving the aforementioned notice from the time monitoring part 365, the rotational driving control part 370 controls the rotary drive part 360 so as to switch the rotational driving direction into the backward rotational direction.

Here, the rotational driving control part 370 controls driving of the rotary drive part 360, which performs the forward rotational driving so that the blade member 222 is directed from the initial position HP (first position P1) toward the protrusion position TP (second position P2), so as to be reversely rotated.

In this way, when the blade member 222 moves from the initial position HP (first position P1) to the protrusion position TP (second position P2), the moving time is longer than the predetermined time because the paper (bundle) is thick, because the material of the paper is hard, or the blade member 222 is damaged. In this case, the rotational driving control part controls the rotary drive part 360 so that the moving direction of the blade member 222 is reversed (i.e. returns to the initial position HP (first position P1)).

Next, an operation of the copy machine 1 (when the document G loaded on the document loading part 11 is copied and undergoes post-processing) will be described.

As a signal showing that the start key constituting the operating unit 70 is operated is supplied, the main control unit 90 detects that the start key is operated. Next, the main control unit 90 drives the first feed roller 12 of the document transport unit 10 to supply the document G to the first scanning face 21*a*. The main control unit 90 generates image data based on the document G supplied to the first scanning face 21*a* by the document scanning unit 20, and temporarily stores the image data in the storing unit 80. To form a toner image on paper T based on the image data that is temporarily stored in the storing unit 80, the main control unit 90 controls the first paper transport unit 30, the toner image forming unit 40, the transfer unit 50, and the fixing unit 60, all of which constitute the image forming unit 3. That is, the main control unit 90 drives the second feed roller 31 or the third feed roller 32 to transport the paper T to the transfer unit 50. Further, the main control unit 90 supplies data of an image, which is generated for each color based on the image data, to the laser scanner unit 43, and forms an electrostatic latent image on the photosensitive drum 41 by the laser light radiated from the laser scanner unit 43. The main control unit 90 causes the developing unit 44 to form a toner image on the photosensitive drum 41, and primarily transfers the toner image to the intermediate transfer belt 48. The main control unit 90 secondarily transfers the toner image, which is primarily transferred to the intermediate transfer belt 48, to the paper T by the secondary transfer roller 51. The main control unit 90 controls the heating rotor 61 so as to be heated to a predetermined temperature, melts a toner of the toner image, which is secondarily transferred to the paper T, by the heating rotor 61, and fixes the toner to the paper T by the pressurizing rotor 62 that is in pressure contact with the heating rotor 61. Further, the main control unit 90 discharges the paper T to which the toner image is fixed from the second paper discharge part 38 by the first paper transport unit 30.

The main control unit 90 controls the post-processing control unit 150 so as to perform post-processing on the paper T discharged from the second paper discharge part 38.

The post-processing control unit 150 carries the paper T discharged from the second paper discharge part 38 into the post-processing apparatus 100 by the second paper transport unit 110. Then, the post-processing control unit 150 stops the transport of the paper T performed by the second paper transport unit 110 at position of the punching unit 120.

The post-processing control unit 150 lowers a punching process part (not shown) of the punching unit 120 toward the paper T, and punches the paper T. The post-processing control unit 150 transports the punched paper T by the second paper transport unit 110, and discharges the paper T from the first discharge part 113.

When a stapling process is performed, the post-processing control unit 150 switches a direction orthogonal to the transport direction of the paper T carried into the post-processing apparatus 100 by the branch guide 112, and temporarily accumulates the paper T in the paper cradle 131. When a predetermined number of sheets of paper T are temporarily accumulated in the paper cradle 131, the post-processing control unit 150 moves the stapling part 133 and performs the stapling process on the vicinity of ends or middles of the sheets of paper T by the stapling part 133. When the stapling process is performed on the vicinity of ends of the sheets of paper T by the stapling part 133, the post-processing control unit 150 discharges a paper bundle on which the stapling process is performed from the first discharge part 113. When the stapling process is performed on the vicinity of middles of the sheets of paper T by the stapling part 133, the post-processing control unit 150 transports a paper bundle undergoing saddle stitch binding to the folding unit 190 (sheet loading member 201).

When a folding process is performed, the rotational driving control part 370 controls the rotary drive part 360 so as to move the blade member 222 toward the paper bundle (paper T) loaded on the sheet loading member 201 (sheet loading face 202). Thereby, the blade member 222 moves toward the folding roller pair 223 while folding the paper bundle, and pushes the folded paper bundle into the first nip N1. Thus, the post-processing control unit 150 controls a variety of driving parts (not shown) so as to fold up the paper bundle by the folding roller pair 223 and to transport the folded paper bundle toward the second discharge part 230.

Next, the process (operation) of folding the paper T performed by the folding unit 190 in the post-processing apparatus 100 will be described in detail based on FIGS. 5 to 11.

Figure 5:
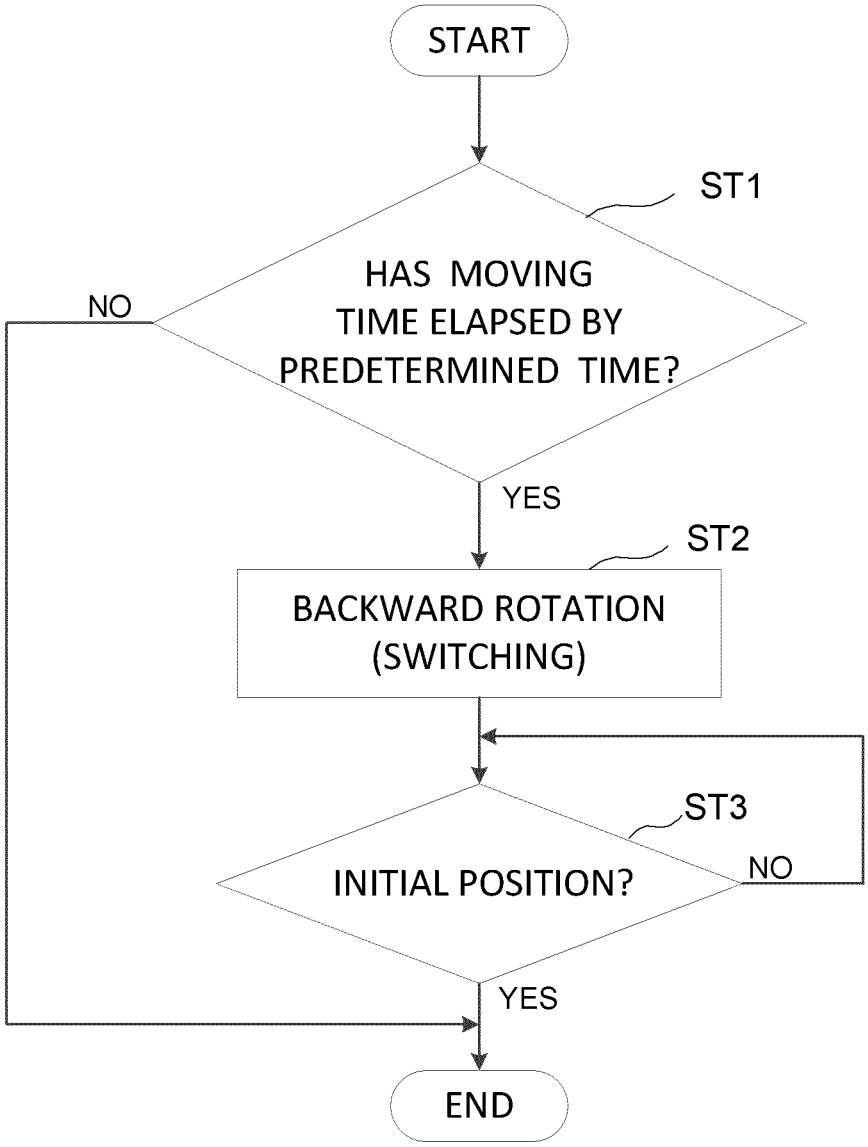
FIG. 5 is a flow chart for describing an operation of the folding unit.
Figure 6:
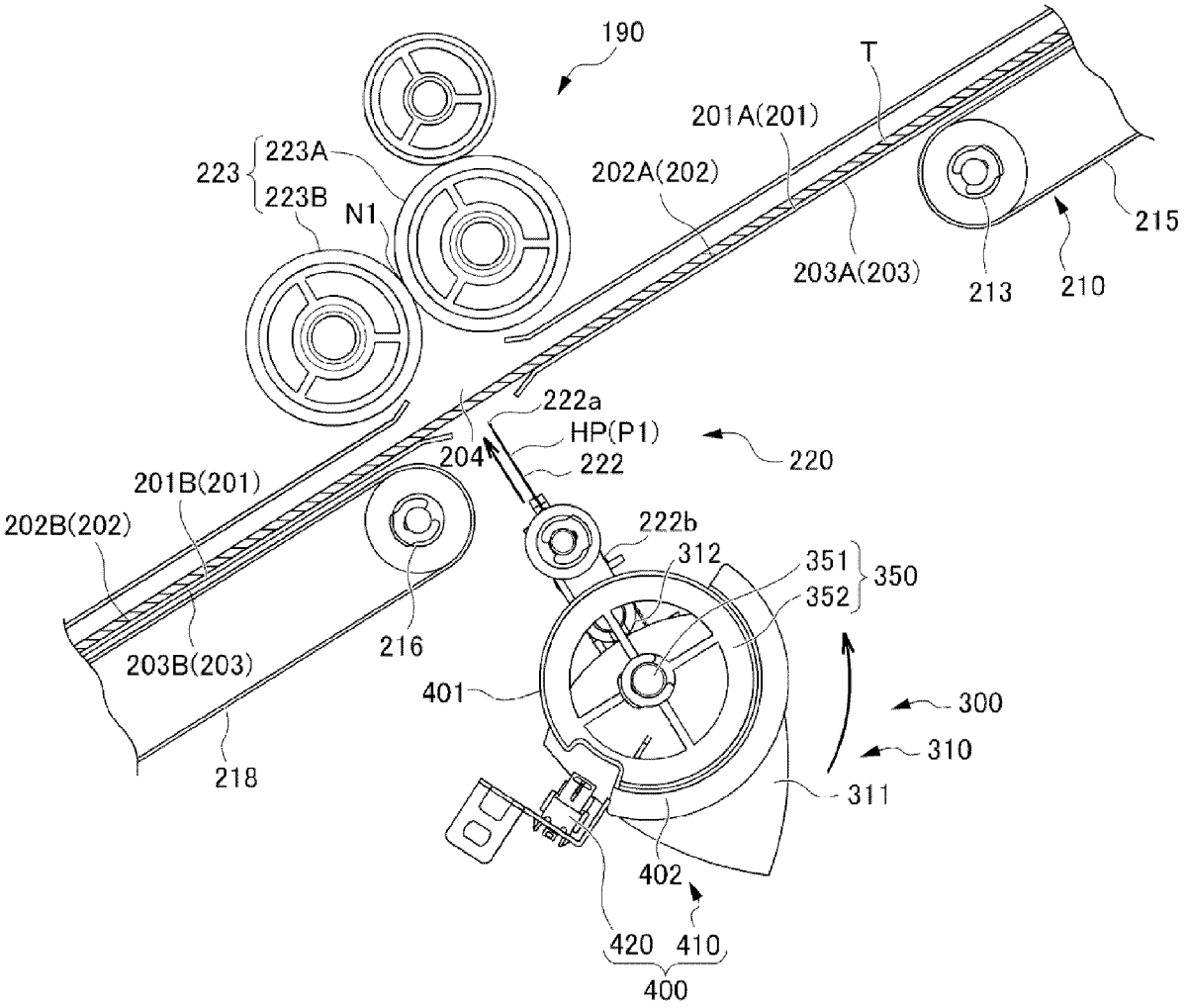
FIG. 6 is a view for describing a state in which a blade is located at an initial position.
Figure 7:
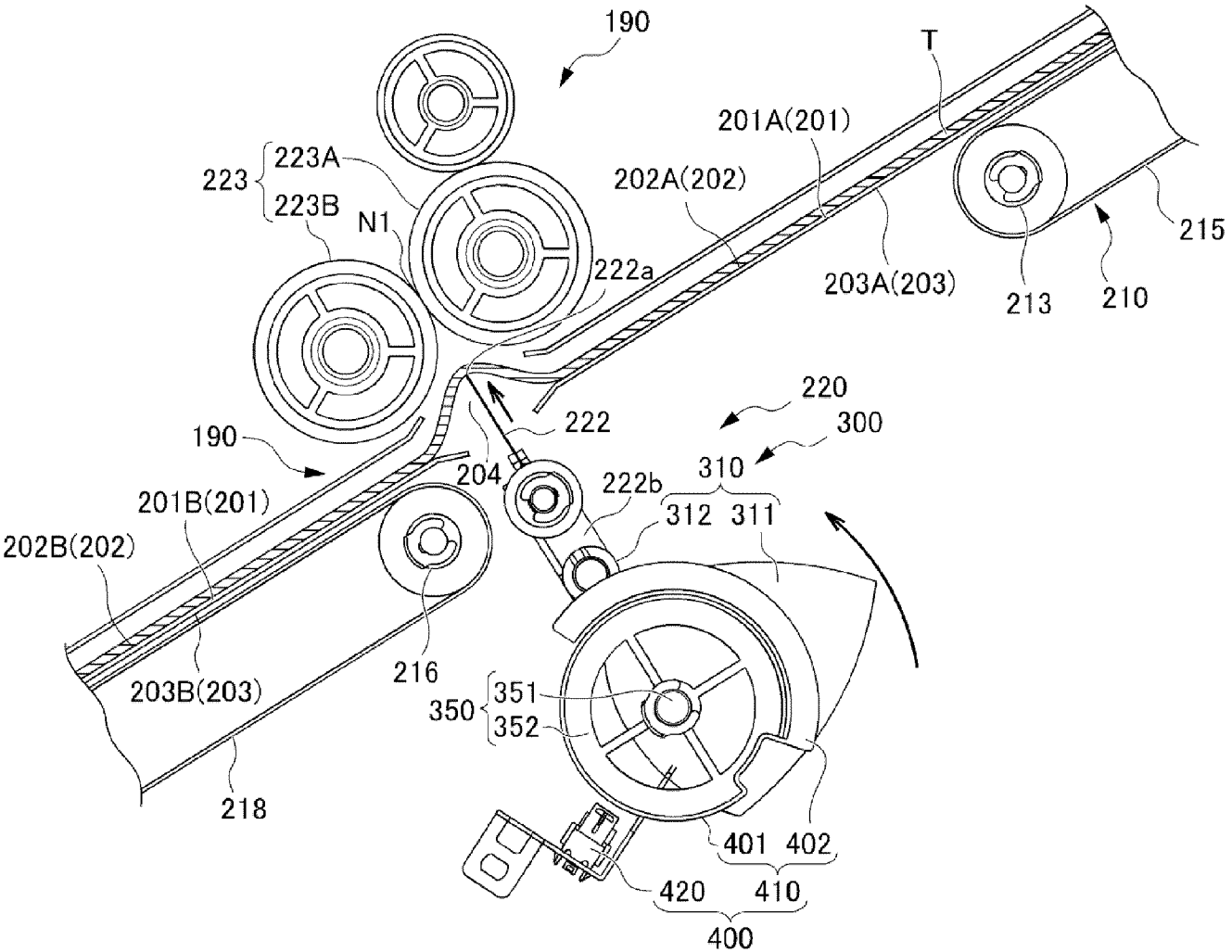
FIG. 7 is a view for describing a state in which the blade is in the course of moving from the initial position to a protrusion position.
Figure 8:
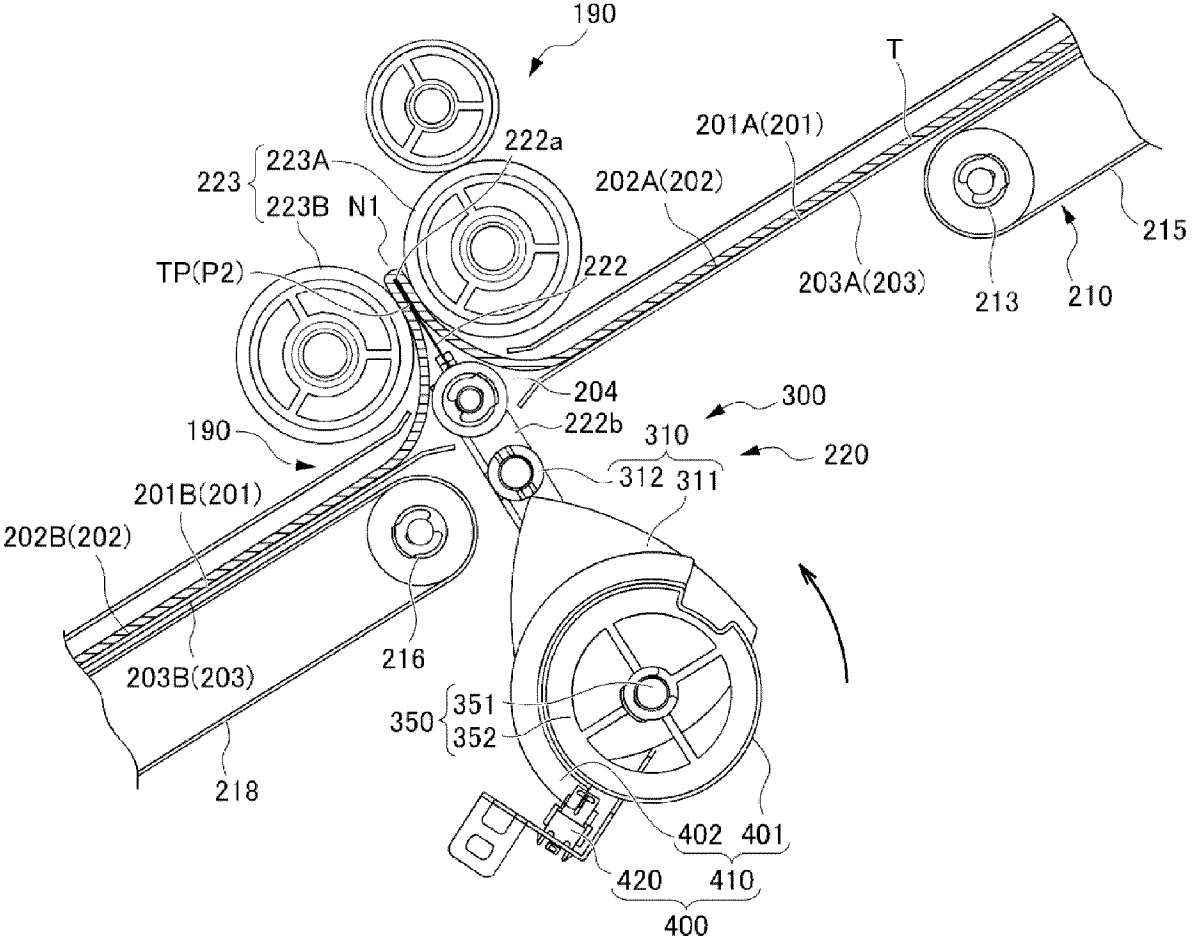
FIG. 8 is a view for describing a state in which the blade is located at the protrusion position.
Figure 9:
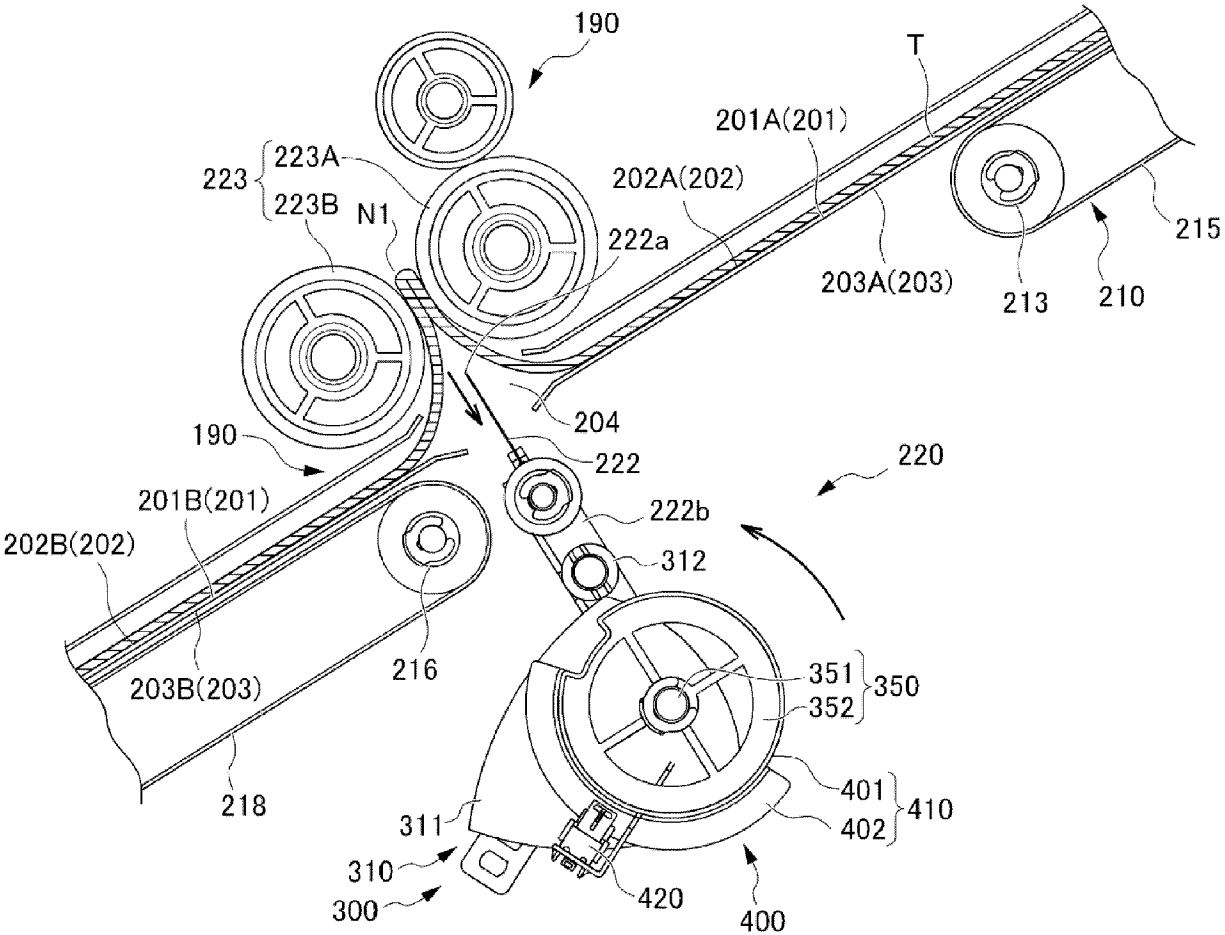
FIG. 9 is a view for describing a state in which the blade moves from the protrusion position toward the initial position.
Figure 10:
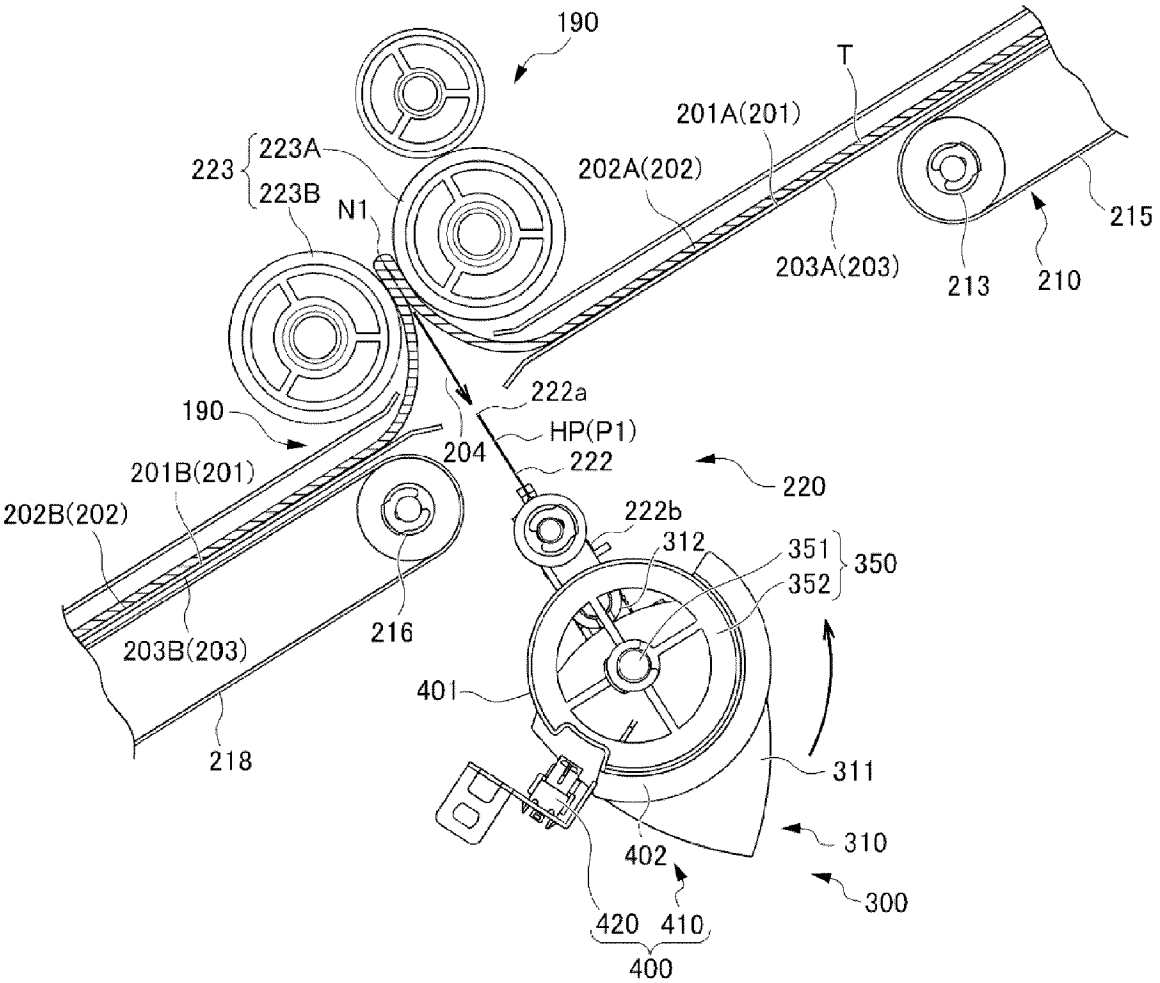
FIG. 10 is a view for describing a state in which the blade returns to the initial position.
Figure 11:
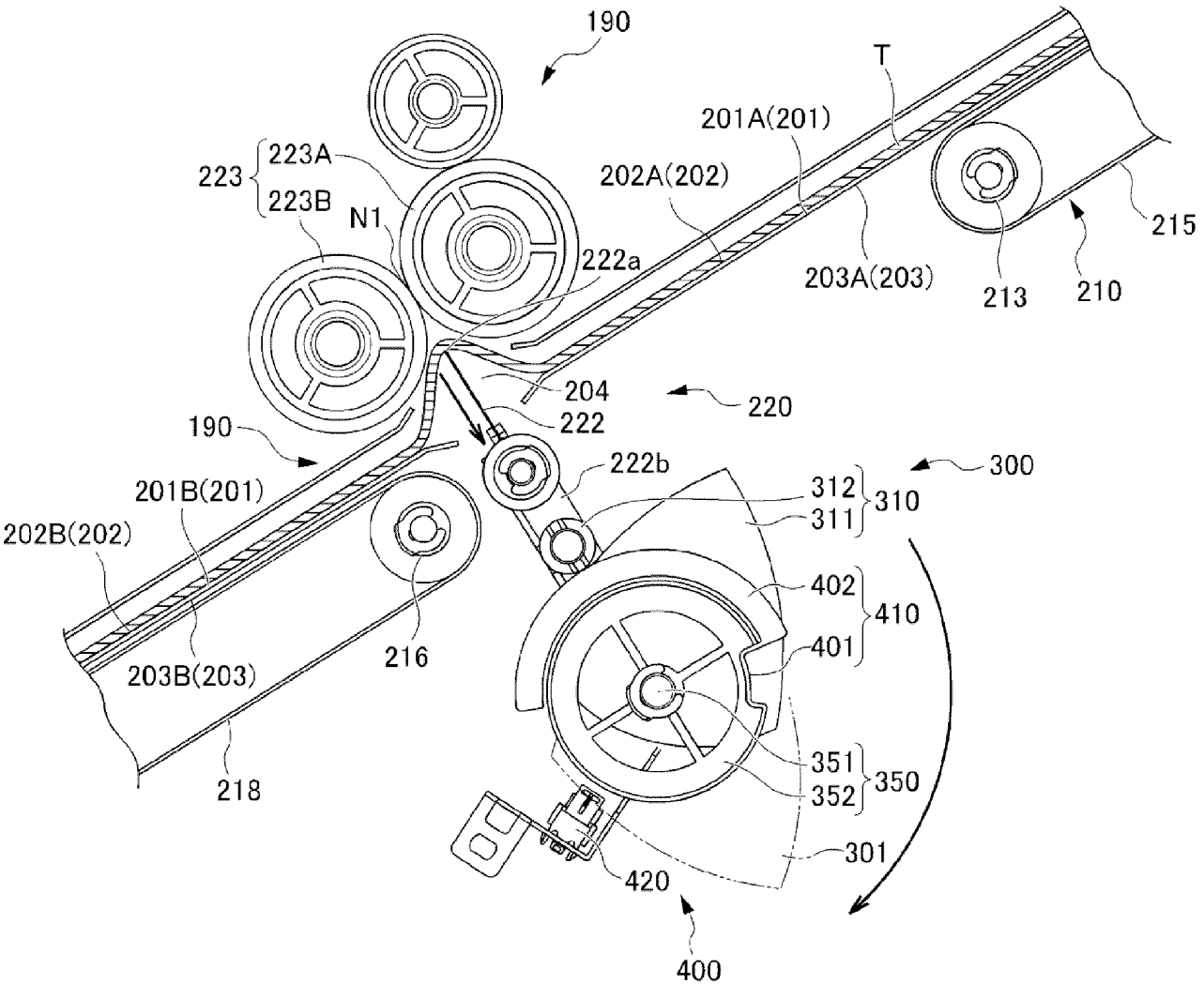
FIG. 11 is a view for describing a state in which the blade further moves from the position of FIG. 7 toward the protrusion position again.

FIG. 5 is a flow chart for describing an operation in the folding unit. FIG. 6 is a view for describing a state in which a blade is located at an initial position. FIG. 7 is a view for describing a state in which the blade is in the course of moving from the initial position to a protrusion position. FIG. 8 is a view for describing a state in which the blade is located at the protrusion position. FIG. 9 is a view for describing a state in which the blade moves from the protrusion position toward the initial position. FIG. 10 is a view for describing a state in which the blade returns to the initial position. FIG. 11 is a view for describing a state in which the blade moves from the position of FIG. 7 toward the protrusion position again.

First, a typical folding process (operation) will be described based on FIGS. 6 to 10.

As shown in FIG. 6, paper T is carried into the folding unit 190 by the transport path 110*d*, and is loaded on the tops of the upstream-side and downstream-side sheet loading faces 202A and 202B of the upstream-side and downstream-side sheet loading members 201A and 201B. A position of the paper T is matched again by the matching part 210.

In this state, the blade member 222 is located at the initial position HP (first position P1), and is on standby. In detail, the blade member 222 is on standby so as to be located at a lower side (side of the opposite face 203) than the upstream-side and downstream-side sheet loading faces 202A and 202B of the upstream-side and downstream-side sheet loading members 201A and 201B.

Subsequently, the rotational driving control part 370 controls the rotary drive part 360 so as to be rotationally driven in a forward rotational direction.

Thereby, as shown in FIG. 7, the rotary member 350 is rotated forward, and the cam member 311 connected to the rotary member 350 is rotated forward.

Further, this causes the tip 222*a* of the blade member 222 to be inserted into the penetration part 204 via the contact member 312 and move toward the sheet loading face 202. The blade member 222 moves from the initial position HP (first position P1) toward the protrusion position TP (second position P2).

In addition, this causes the blade member 222 to come into contact with the paper T and move toward the folding roller pair 223 while bending the paper T.

Continuously, the rotational driving control part 370 controls the rotary drive part 360 so as to continue to be rotationally driven in the forward rotational direction.

Thereby, as shown in FIG. 8, the rotary member 350 is further rotated forward, and the cam member 311 connected to the rotary member 350 is further rotated forward.

Further, this causes the tip 222*a* of the blade member 222 to further move to (be located at) the protrusion position TP via the contact member 312.

In addition, this causes the blade member 222 to push the bent paper T into the first nip N1 formed by the folding roller pair 223.

Continuously, the rotational driving control part 370 controls the rotary drive part 360 so as to continue to be rotationally driven in the forward rotational direction.

Thereby, as shown in FIG. 9, the rotary member 350 is further rotated forward, and the cam member 311 connected to the rotary member 350 is further rotated forward.

Further, this causes the blade member 222 (tip 222*a*) to move from the protrusion position TP toward the initial position HP in cooperation with movement of the contact member 312 which is brought into contact with an outer edge of the cam member 311 by the spring member 380.

In addition, this causes the blade member 222 to be separated from the bent paper T.

Then, the rotational driving control part 370 controls the rotary drive part 360 so as to continue to be rotationally driven in the forward rotational direction.

Thereby, as shown in FIG. 10, the rotary member 350 is further rotated forward, and the cam member 311 connected to the rotary member 350 is further rotated forward.

Further, this causes the tip 222*a* of the blade member 222 to further move to (be located at) the initial position HP in cooperation with the movement of the contact member 312 which is brought into contact with the outer edge of the cam member 311 by the spring member 380.

Then, if it is detected by the position detecting mechanism 400 (position recognition part 362) that the blade member 222 is located at the initial position HP (first position P1), the rotational driving control part 370 controls the rotary drive part 360 so as to stop the rotational driving.

The folding roller pair 223 receives the paper T pushed by the blade member 222, and sends the paper T to the transport path 110*e* while making a fold.

Further, the paper T on which the folding process is performed is discharged from the second discharge part 230.

Thus, the post-processing apparatus 100 (folding unit 190) stops the folding process (operation).

Subsequently, the folding process (operation) when an abnormality occurs will be described based on FIG. 5 with reference to FIG. 11.

The rotary drive part 360 is set as being rotationally driven in the forward rotational direction by the rotational driving control part 370. In step ST1, the rotational driving control part 370 measures whether to receive a notice (signal) to the effect that a moving time has elapsed by a predetermined time from the time monitoring part 365.

When the notice is received (step ST1, YES), the rotational driving control part 370 advances a process to step ST2.

Then, in step ST2, the rotational driving control part 370 controls the rotary drive part 360 so as to be driven (switched) in the backward rotation in which the direction is reversed.

The blade member 222 moves, for instance, from the position shown in FIG. 11 to the initial position HP shown in FIG. 6 through the position shown in FIG. 7.

Thereby, the blade member 222 returns to the initial position HP without being located at the protrusion position TP at which a higher load is applied. The blade member 222 can return to the initial position HP in a low load state.

In step ST3, the rotational driving control part 370 measures whether to receive a notice (signal) to the effect that the blade member 222 is located at the initial position HP (first position P1) from the position detecting mechanism 400 (position recognition part 362). The rotational driving control part 370 waits for the notice to the effect that the blade member 222 is located at the initial position HP to be sent from the position detecting mechanism 400 (step ST3, NO).

When receiving the notice (signal) to the effect that the blade member 222 is located at the initial position HP (first position P1) from the position detecting mechanism 400 (position recognition part 362) (step ST3, YES), the rotational driving control part 370 stops the driving of the rotary drive part 360 based on the backward rotation. The post-processing apparatus 100 (folding unit 190) stops the folding process (operation).

Further, in step ST1, when the notice (signal) to the effect that the moving time has elapsed by the predetermined time is not received from the time monitoring part 365 (step ST1, NO), the rotational driving control part 370 continues the control of rotationally driving the rotary drive part 360 in the forward rotational direction. Upon receiving the notice to the effect that the blade member 222 is located at the initial position HP from the position detecting mechanism 400 without receiving the notice to the effect that the moving time has elapsed by the predetermined time from the time monitoring part 365, the rotational driving control part 370 stops the driving of the rotary drive part 360, because the folding process performed by the blade member 222 is completed normally.

According to the present embodiment, the post-processing apparatus capable of suppressing damage to the folding member and reducing a work burden imposed on a worker when a malfunction occurs can be provided.

Further, according to the present embodiment, the image forming apparatus equipped with the post-processing apparatus can be provided.

In the present embodiment, the post-processing apparatus 100 (copy machine 1) is equipped with: the drive mechanism which reciprocates the blade member 222 between the initial position HP and the protrusion position TP and which includes the rotary drive part 360 capable of outputting a rotational driving force and switching a rotational driving direction, the rotary member 350 directly or indirectly connected to the rotary drive part 360 and rotated by the rotational driving force from the rotary drive part 360, and the cam mechanism 310 changing rotational motion of the rotary member 350 connected to the rotary member 350 into reciprocating motion; the position detecting mechanism 400 which detects that the blade member 222 is located at the first position P1 between the initial position HP and the protrusion position TP and that the blade member 222 is located at the second position P2 nearer the protrusion position TP than the first position P1 that is between the initial position HP and the protrusion position TP; the timer 363 capable of outputting time information; the time monitoring part 365 which measures a moving time that is a time from when the position detecting mechanism 400 detects that the blade member 222 is located at the first position P1 to when the position detecting mechanism 400 detects that the blade member 222 is located at the second position P2 based on the time information from the timer 363, and which determines whether the moving time has elapsed by a predetermined time; and the rotational driving control part 370 which controls the rotary drive part 360 so as to switch a direction of the rotary drive part 360 into a backward rotational direction when the time monitoring part 365 determines that the moving time has elapsed by the predetermined time.

Thereby, the post-processing apparatus 100 (copy machine 1) can return the blade member 222 back to the initial position HP in a low load state. Thus, the post-processing apparatus 100 (copy machine 1) can suppress (additional) damage to the blade member 222. Further, the post-processing apparatus 100 (copy machine 1) can suppress a work burden imposed on a user.

Further, in the present embodiment, the position detecting mechanism 400 includes the detected part 410 disposed on the rotary member 350, and the detection sensor 420 disposed at a position corresponding to the detected part 410 and detecting detection information about the detected part 410.

Thereby, the post-processing apparatus 100 (copy machine 1) can determine a position of the blade member 222 based on the detection information. Thus, the post-processing apparatus 100 (copy machine 1) can detect that the blade member 222 is located at the first position P1 and that the blade member 222 is located at the second position P2 with a simple configuration.

Further, in the present embodiment, the cam mechanism 310 changes rotational motion into reciprocating motion so that, when the rotary member 350 is rotated once, the blade member is reciprocated once. Thereby, the post-processing apparatus 100 (copy machine 1) can accurately determine a position and moved state of the blade member 222 by acquiring rotational position information about the rotary member 350.

Further, in the present embodiment, when the position detecting mechanism 400 detects that the blade member 222 is located at the initial position HP after the aforementioned control, the rotational driving control part 370 controls the rotary drive part 360 so as to stop the rotational driving. Thereby, the post-processing apparatus 100 (copy machine 1) allows the blade member 222 to be reliably located at the initial position HP when abnormality takes place. Further, the post-processing apparatus 100 (copy machine 1) can suppress the work burden imposed on the user.

While the exemplary embodiments of the post-processing apparatus 100 (copy machine 1) relating to the present disclosure have been described, the post-processing apparatus 100 (copy machine 1) relating to the present disclosure may be implemented in various forms without being limited to the aforementioned embodiments.

Further, in the present embodiment, the rotational driving control part 370 is included in the side of the post-processing apparatus 100, but it is not limited to this. The rotational driving control part 370 may be included in the side of the copy machine main body 2.

Further, in the present embodiment, the first position P1 is the initial position HP, whereas the second position P2 is the protrusion position TP, but the first and second positions are not limited to these. The first position P1 may be set to a predetermined position between the initial position HP and the protrusion position TP. Further, the second position P2 may be set to a predetermined position between the first position P1 and the protrusion position TP.

Further, the first position P1 may be set to the initial position HP or the vicinity of the initial position HP as a preferred example. Further, the second position P2 may be set to the protrusion position TP or the vicinity of the protrusion position TP as a preferred example.

Further, in the present embodiment, the detection sensor is a type that detects transmitted light, but it is not limited to this. The detection sensor may be, for instance, a type that detects reflected light or a type that directly measures an angle of rotation.

Further, in the present embodiment, the detected part is a type that has a light transmitting part (transmitted region) and a light shielding part (untransmitted region) that are continuous throughout a predetermined region, but it is not limited to this. The detected part may be, for instance, a type in which the light transmitting parts (or light shielding parts, or reflecting parts) are formed at predetermined intervals, or a type that has the light transmitting part (or light shielding part, or reflecting part) that is continuous but formed so that a width thereof is narrowed (widened) according to a position.

Further, in the present embodiment, the detected part includes the second detection region 402 as a first detected part for detecting that the blade member 222 is located at the first position P1, and the first detection region 401 as a second detected part for detecting that the blade member 222 is located at the second position P2. The first detected part of the detected part is disposed so as to be located at a detected position of the detection sensor 420 in the state in which the blade member 222 is located at the first position P1, and the second detected part is formed at a position that is not detected by the detection sensor 420 in the state in which the blade member 222 is located at the second position P2.

In this case, the position detecting mechanism is configured to be able to more easily detect that the blade member 222 is located at the first position P1 and that the blade member 222 is located at the second position P2.

Figure 12:
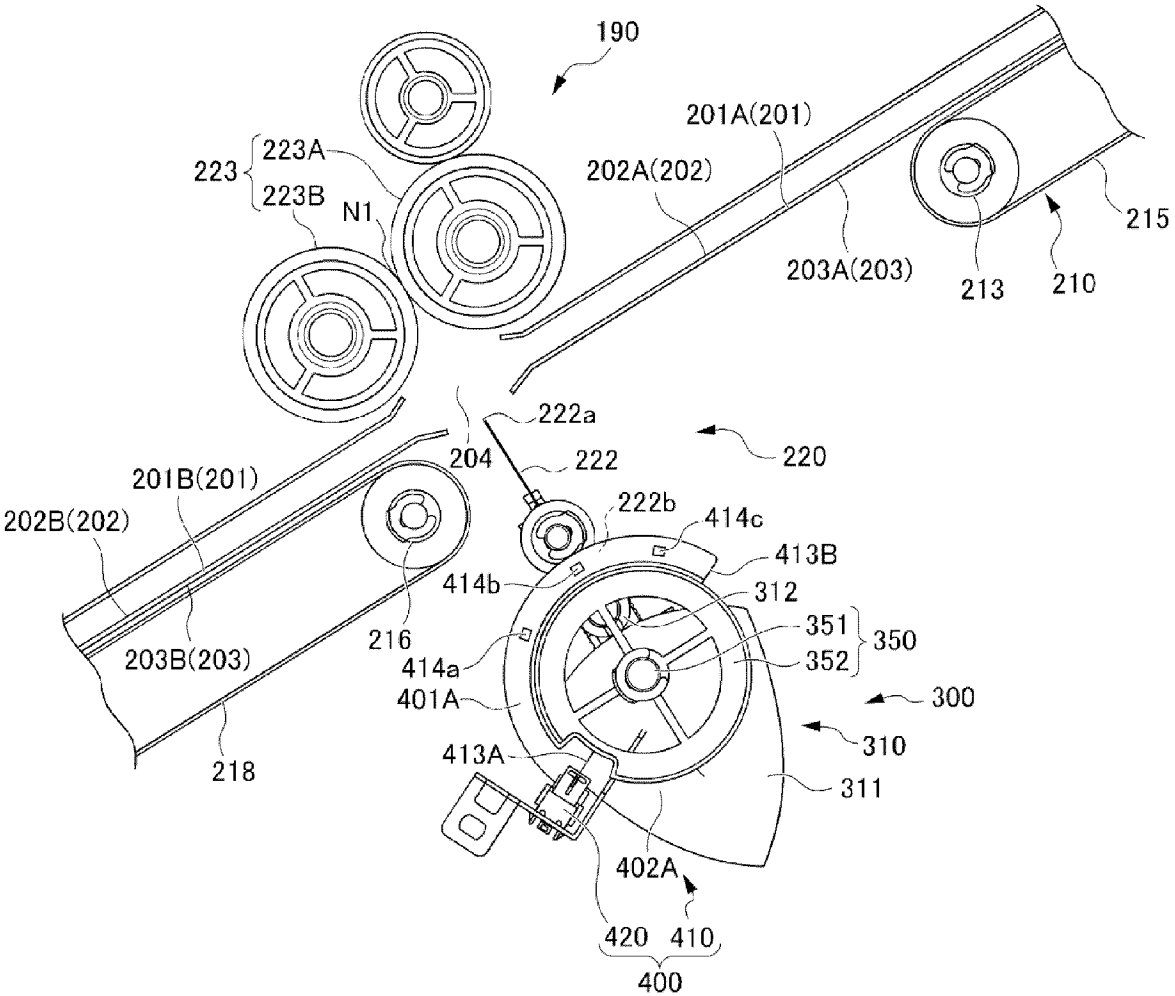
FIG. 12 is a view for describing another form in a position detected part.

Further, as the aforementioned other form, for example, the detected part of an aspect shown in FIG. 12 may be illustrated. FIG. 12 is a view for describing another form in the position detected part.

As shown in FIG. 12, the detected part 410 includes a first detection region 401A and a second detection region 402A. Unlike the aforementioned embodiment, the first detection region 401A is a light non-transmitting region, whereas the second detection region 402A is a light transmitting region.

Further, one end edge of the first detection region 401A forms an initial position detecting part 413A disposed at a detected position in the state in which the blade member 222 is located at the initial position HP. Further, the other end edge of the first detection region 401A forms a protrusion position detected part 413B disposed at a detected position in the state in which the blade member 222 is located at the protrusion position TP.

Further, the first detection region 401A includes a plurality of detected hole parts 414*a*, 414*b*, and 414*c* that are formed in a through-hole shape at predetermined intervals. That is, the first detection region 401A is provided at a circumferential edge portion of the rotary member 350 which corresponds to an operating rotation region until the blade member 222 moves from the initial position HP to the protrusion position TP. The detected hole parts 414*a*, 414*b*, and 414*c*, which are detected holes used as targets to be detected by the detection sensor 420, are formed in the first detection region 401A. The light-emitting and light-receiving parts of the detection sensor 420 are disposed at positions facing the detected hole parts 414*a*, 414*b*, and 414*c*.

Here, as the first detected part for detecting the first position P1, the initial position detecting part 413A and any one of the detected hole parts 414*a*, 414*b*, and 414*c* may be set. In this case, the detection sensor 420 detects, for instance, arrivals of the detected hole parts 414*a*, 414*b*, and 414*c* based on a change from an unreceived light state to a received light state in the light from the light-emitting part and an elapsed time for which the light is in the received light state.

Further, as the second detected part for detecting the second position P2, the protrusion position detected part 413B and any one of the detected hole parts 414*a*, 414*b*, and 414*c* which is nearer the protrusion position detected part 413B than the detected part corresponding to the first position P1 may be set.

Thereby, when the rotary drive part 360 is rotationally driven in the forward rotational direction, in the step before the blade member 222 moves from the initial position HP and the tip 222*a* pushes up the paper T, a time for which the blade member 222 moves from the first position P1 to the second position P2 exceeds a predetermined elapsed time, in which an abnormality is predicted to take place. In this case, the rotational driving control part 370 can drive the rotary drive part 360 in backward rotation. For this reason, before the blade member 222 is damaged after beginning to push up the paper T, and return work gets difficult, the blade member 222 can return to the initial position HP.

Further, in the present embodiment, the post-processing apparatus having the folding process part has been described. However, the folding apparatus having the folding unit is also similarly disclosed in the contents of the present disclosure.

Further, the copy machine 1 of the present embodiment transfers the toner image to the paper T via the intermediate transfer belt 48 (indirect transfer system), but it is not limited to this form. The copy machine may directly transfer the toner image formed on the photosensitive drum to the paper (direct transfer system).

Further, the copy machine 1 of the present embodiment is configured to print one side of the paper T, but it is not limited to this. The copy machine may be configured to print both sides of the paper.

Further, the copy machine 1 of the present embodiment is a color copy machine, but it is not limited to this. The copy machine may be a monochromatic copy machine.

In addition, the image forming apparatus of the present disclosure is not limited to the aforementioned copy machine 1. That is, the image forming apparatus of the present disclosure may be a multifunction peripheral having a copy function, a facsimile function, a printer function, and a scanner function, or may be a facsimile or a printer.

Further, the image forming medium to which the toner image is fixed by the image forming apparatus of the present disclosure is not limited to the paper T. For example, the image forming medium may be a film sheet such as an overhead projector (OHP) sheet.

Further, the folding apparatus of the present disclosure folds sheets including a sheet-like image forming medium, and a film sheet.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A post-processing apparatus configured to be connectable to an image forming apparatus main body, including:

a transport path along which a sheet-like image forming medium is transportable in a predetermined transport direction;

a loading part which includes a loading face on which the image forming medium is loadable and on which a penetration part penetrating to an opposite face of the loading face is formed, and which constitutes a part of the transport path;

a first folding member which is disposed at a side of the opposite face in the loading part; which is disposed so as to be movable between an initial position at which a tip thereof is located at a predetermined position of the side of the opposite face and a protrusion position at which the tip thereof is inserted into the penetration part and is located at a predetermined position of a side of the loading face; and which moves from the initial position to the protrusion position in a state in which the image forming medium is disposed on the loading part, thereby moving the image forming medium while bending the image forming medium;

a second folding member which is disposed at the side of the loading face in the loading part, and which sandwiches and receives the first folding member along with the bent image forming medium in a state in which the first folding member is located at the protrusion position;

a drive mechanism which reciprocates the first folding member between the initial position and the protrusion position, and which includes:

a rotary drive part that is allowed to output a rotational driving force and to switch a rotational driving direction;

a rotary member that is directly or indirectly connected to the rotary drive part and is rotated by the rotational driving force from the rotary drive part; and a changing part that changes rotational motion of the rotary member into rectilinear reciprocating motion in a moving direction of the first folding member;

a position detecting unit which detects that the first folding member is located at a first position between the initial position and the protrusion position and that the first folding member is located between the initial position and the protrusion position, which is located at a second position nearer the protrusion position than the first position;

a time information output part that is allowed to output time information;

a time monitoring part which measures a moving time that is a time from when the position detecting unit detects that the first folding member is located at the first position to when the position detecting unit detects that the first folding member is located at the second position based on the time information from the time information output part, and which determines whether the moving time has elapsed by a predetermined time; and a rotational driving control part which controls the rotary drive part so as to switch the rotational driving direction to a backward rotational direction when the time monitoring part determines that the moving time has elapsed by the predetermined time.

2. The post-processing apparatus according to claim 1, wherein the position detecting unit includes:

a detected part which is disposed on the rotary member, and which includes a first detected part for detecting that the first folding member is located at the first position and a second detected part for detecting that the first folding member is located at the second position; and a detection sensor which is disposed at a position corresponding to the detected part, and which detects position information about the first detected part and the second detected part.

3. The post-processing apparatus according to claim 2, wherein:

the detection sensor is a photosensor disposed at a position that faces the detected part;

the detected part is provided at a circumferential edge portion of the rotary member which corresponds to an operating rotation region until the first folding member moves from the first position to the second position, and includes a plurality of detected holes that are used as targets to be detected by the detection sensor;

either one end of the detected part or one of the plurality of detected holes is used as the first detected part;

either the other end of the detected part which becomes a side of a rotational direction of the rotary member based on movement of the first folding member toward the second position rather than the one end or one of the other detected holes, which belongs to the plurality of detected holes, and which is located at a side of the rotational direction of the rotary member based on movement of the first folding member toward the second position rather than the detected hole serving as the first detected part, is used as the second detected part.

4. The post-processing apparatus according to claim 1, wherein the rotational driving control part stops rotational driving of the rotary drive part when the position detecting unit detects that the first folding member is located at the initial position.

5. The post-processing apparatus according to claim 1, wherein the changing part changes the rotational motion of the rotary member into the reciprocating motion of the first folding member so that, when the rotary member is rotated once, the first folding member is reciprocated once.

6. The post-processing apparatus according to claim 1, wherein:

the first position is the initial position or a vicinity of the initial position; and the second position is the protrusion position or a vicinity of the protrusion position.

7. An image forming apparatus including:

a transport path along which a sheet-like image forming medium is transportable in a predetermined transport direction;

a loading part which includes a loading face on which the image forming medium is loadable and on which a penetration part penetrating to an opposite face of the loading face is formed, and which constitutes a part of the transport path;

a first folding member which is disposed at a side of the opposite face in the loading part; which is disposed so as to be movable between an initial position at which a tip thereof is located at a predetermined position of the side of the opposite face and a protrusion position at which the tip thereof is inserted into the penetration part and is located at a predetermined position of a side of the loading face; and which moves from the initial position to the protrusion position in a state in which the image forming medium is disposed on the loading part, thereby moving the image forming medium while bending the image forming medium;

a second folding member which is disposed at the side of the loading face in the loading part, and which sandwiches and receives the first folding member along with the bent image forming medium in a state in which the first folding member is located at the protrusion position;

a drive mechanism which reciprocates the first folding member between the initial position and the protrusion position, and which includes:

a rotary drive part that is allowed to output a rotational driving force and to switch a rotational driving direction;

a rotary member that is directly or indirectly connected to the rotary drive part and is rotated by the rotational driving force from the rotary drive part; and a changing part that changes rotational motion of the rotary member into rectilinear reciprocating motion in a moving direction of the first folding member;

a position detecting unit which detects that the first folding member is located at a first position between the initial position and the protrusion position and that the first folding member is located between the initial position and the protrusion position, which is located at a second position nearer the protrusion position than the first position;

a time information output part that is allowed to output time information;

a time monitoring part which measures a moving time that is a time from when the position detecting unit detects that the first folding member is located at the first position to when the position detecting unit detects that the first folding member is located at the second position based on the time information from the time information output part, and which determines whether the moving time has elapsed by a predetermined time; and a rotational driving control part which controls the rotary drive part so as to switch the rotational driving direction to a backward rotational direction when the time monitoring part determines that the moving time has elapsed by the predetermined time.

8. A folding apparatus including:

a transport path along which a sheet is transportable in a predetermined transport direction;

a loading part which includes a loading face on which the sheet is loadable and on which a penetration part penetrating to an opposite face of the loading face is formed, and which constitutes a part of the transport path;

a first folding member which is disposed at a side of the opposite face in the loading part; which is disposed so as to be movable between an initial position at which a tip thereof is located at a predetermined position of the side of the opposite face and a protrusion position at which the tip thereof is inserted into the penetration part and is located at a predetermined position of a side of the loading face; and which moves from the initial position to the protrusion position in a state in which the sheet is disposed on the loading part, thereby moving the sheet while bending the sheet;

a second folding member which is disposed at the side of the loading face in the loading part, and which sandwiches and receives the first folding member along with the bent sheet in a state in which the first folding member is located at the protrusion position;

a drive mechanism which reciprocates the first folding member between the initial position and the protrusion position, and which includes:

a rotary drive part that is allowed to output a rotational driving force and to switch a rotational driving direction;

a rotary member that is directly or indirectly connected to the rotary drive part and is rotated by the rotational driving force from the rotary drive part; and a changing part that changes rotational motion of the rotary member into rectilinear reciprocating motion in a moving direction of the first folding member;

a position detecting unit which detects that the first folding member is located at a first position between the initial position and the protrusion position and that the first folding member is located between the initial position and the protrusion position, which is located at a second position nearer the protrusion position than the first position;

a time information output part that is allowed to output time information;

a time monitoring part which measures a moving time that is a time from when the position detecting unit detects that the first folding member is located at the first position to when the position detecting unit detects that the first folding member is located at the second position based on the time information from the time information output part, and which determines whether the moving time has elapsed by a predetermined time; and a rotational driving control part which controls the rotary drive part so as to switch the rotational driving direction into a backward rotational direction when the time monitoring part determines that the moving time has elapsed by the predetermined time.

* * * * *